US010780692B2

(12) United States Patent
Ono et al.

(10) Patent No.: US 10,780,692 B2
(45) Date of Patent: Sep. 22, 2020

(54) DROPLET DISCHARGING APPARATUS AND MAINTENANCE METHOD FOR DROPLET DISCHARGING APPARATUS

(71) Applicant: SEIKO EPSON CORPORATION, Tokyo (JP)

(72) Inventors: Atsushi Ono, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/506,007

(22) Filed: Jul. 9, 2019

(65) Prior Publication Data

US 2020/0016893 A1 Jan. 16, 2020

(30) Foreign Application Priority Data

Jul. 10, 2018 (JP) ..... 2018-130461

(51) Int. Cl.
*B41J 2/045* (2006.01)
*B41J 2/165* (2006.01)

(52) U.S. Cl.
CPC ..... *B41J 2/04588* (2013.01); *B41J 2/04581* (2013.01); *B41J 2/1652* (2013.01); *B41J 2/16505* (2013.01)

(58) Field of Classification Search
CPC ..... B41J 2/04503; B41J 2/04505; B41J 2/04506; B41J 2/04508; B41J 2/04513; B41J 2/04515; B41J 2/04516; B41J 2/04525; B41J 2/04535; B41J 2/04551; B41J 2/04573; B41J 2/04583; B41J 2/04588; B41J 2/0459; B41J 2/04591; B41J 2/04593; B41J 2/04595
See application file for complete search history.

(56) References Cited

U.S. PATENT DOCUMENTS

2004/0223027 A1 11/2004 Shinkawa et al.
2006/0007260 A1 1/2006 Oku
2010/0020126 A1* 1/2010 Takahashi ..... B41J 2/16532 347/30
2011/0285775 A1 11/2011 Shinkawa
(Continued)

FOREIGN PATENT DOCUMENTS

JP 2013-118133 A 4/2003
JP 2004-276544 A 10/2004
(Continued)

*Primary Examiner* — Kristal Feggins
(74) *Attorney, Agent, or Firm* — Workman Nydegger

(57) ABSTRACT

A droplet discharging apparatus includes: a droplet discharger including a pressure chamber, an actuator and a nozzle provided corresponding to the pressure chamber, and a discharge flow path coupled to the pressure chamber, the droplet discharger performing a recording process by discharging liquid in the pressure chamber from the nozzle in the form of droplets; and a return flow path coupled to the discharge flow path and forming a circulation path. The droplet discharging apparatus performs as a maintenance operation for the droplet discharger, a first discharge operation of causing the liquid in the pressure chamber to be discharged toward the return flow path via the discharge flow path when no droplets are discharged from the nozzle during the recording process.

10 Claims, 13 Drawing Sheets

(56) References Cited

U.S. PATENT DOCUMENTS

| | | | | |
|---|---|---|---|---|
| 2012/0056933 | A1* | 3/2012 | Tanaka | B41J 2/16523 347/30 |
| 2013/0083107 | A1 | 4/2013 | Nishikawa et al. | |
| 2015/0054879 | A1 | 2/2015 | Ready et al. | |
| 2015/0062255 | A1 | 3/2015 | Sasaki | |
| 2015/0202872 | A1 | 7/2015 | Komatsu et al. | |
| 2015/0231907 | A1 | 8/2015 | Otokita et al. | |
| 2015/0367633 | A1 | 12/2015 | Murate | |
| 2016/0167364 | A1 | 6/2016 | Matsumoto et al. | |
| 2016/0288524 | A1* | 10/2016 | Ishikawa | B41J 2/17566 |
| 2017/0057217 | A1 | 3/2017 | Hayashi | |
| 2018/0072066 | A1 | 3/2018 | Yoneta | |

FOREIGN PATENT DOCUMENTS

| | | | |
|---|---|---|---|
| JP | 2005-231085 | A | 9/2005 |
| JP | 2006-021388 | A | 1/2006 |
| JP | 2008-246844 | A | 10/2008 |
| JP | 2011-240564 | A | 12/2011 |
| JP | 2013-075490 | A | 4/2013 |
| JP | 2014-094449 | A | 5/2014 |
| JP | 2014-094505 | A | 5/2014 |
| JP | 2015-039886 | A | 3/2015 |
| JP | 2015-063109 | A | 4/2015 |
| JP | 2015-071289 | A | 4/2015 |
| JP | 2015-136877 | A | 7/2015 |
| JP | 2015-150770 | A | 8/2015 |
| JP | 2016-020088 | A | 2/2016 |
| JP | 2016-112713 | A | 6/2016 |
| JP | 2017-043087 | A | 3/2017 |
| JP | 2017-052227 | A | 3/2017 |
| JP | 2017-114660 | A | 8/2017 |
| JP | 2017-209821 | A | 11/2017 |
| JP | 2018-047683 | A | 3/2018 |

* cited by examiner

DROPLET DISCHARGING APPARATUS AND MAINTENANCE METHOD FOR DROPLET DISCHARGING APPARATUS

The present application is based on, and claims priority from JP Application Serial Number 2018-130461, filed Jul. 10, 2018, the disclosure of which is hereby incorporated by reference herein in its entirety.

BACKGROUND

1. Technical Field

The present disclosure relates to a droplet discharging apparatus such as an ink jet printer and a maintenance method for a droplet discharging apparatus.

2. Related Art

In JP-A-2004-276544, a droplet discharging apparatus that performs a flushing operation of preliminarily discharging droplets from a nozzle to suppress an increase in viscosity of liquid is described.

In the droplet discharging apparatus described in JP-A-2004-276544, the flushing operation is regularly performed as nozzle maintenance. Therefore, the amount of liquid consumed for maintenance is large.

SUMMARY

According to an aspect of the disclosure, there is provided a droplet discharging apparatus including: a droplet discharger including a common liquid chamber to which liquid is supplied from a liquid supply source via a liquid supply flow path, a plurality of pressure chambers communicating with the common liquid chamber, actuators provided respectively corresponding to the plurality of pressure chambers, nozzles provided respectively corresponding to the plurality of pressure chambers, and a discharge flow path coupled to the pressure chambers such that the liquid in the pressure chambers are discharged to an outside, the droplet discharger performing a recording process with respect to a recording medium by driving the actuators such that the liquid in the pressure chambers are discharged from the nozzles in the form of droplets; a return flow path coupled to the discharge flow path and forming a circulation path for circulation of the liquid together with the liquid supply flow path; and a controller performs, as a maintenance operation for the droplet discharger, a first discharge operation of causing the liquid in the pressure chambers to be discharged toward the return flow path via the discharge flow path when no droplets are discharged from the nozzles during the recording process.

According to another aspect of the disclosure, there is provided a maintenance method for a droplet discharging apparatus which includes: a droplet discharger including a common liquid chamber to which liquid is supplied from a liquid supply source via a liquid supply flow path, a plurality of pressure chambers communicating with the common liquid chamber, actuators provided respectively corresponding to the plurality of pressure chambers, nozzles provided respectively corresponding to the plurality of pressure chambers, and a discharge flow path coupled to the pressure chambers such that the liquid in the pressure chambers are discharged to an outside, the droplet discharger performing a recording process with respect to a recording medium by driving the actuators such that the liquid in the pressure chambers are discharged from the nozzles in the form of droplets; and a return flow path coupled to the discharge flow path and forming a circulation path for circulation of the liquid together with the liquid supply flow path, the method including performing, as a maintenance operation for the droplet discharger, a first discharge operation of causing the liquid in the pressure chambers to be discharged toward the return flow path via the discharge flow path when no droplets are discharged from the nozzles during the recording process.

DESCRIPTION OF EXEMPLARY EMBODIMENTS

Hereinafter, an embodiment of a droplet discharging apparatus will be described with reference to drawings. The droplet discharging apparatus is an ink jet printer which records an image such as a character or a photograph by discharging ink, which is an example of liquid, to a recording medium such as a paper sheet.

Figure 1:
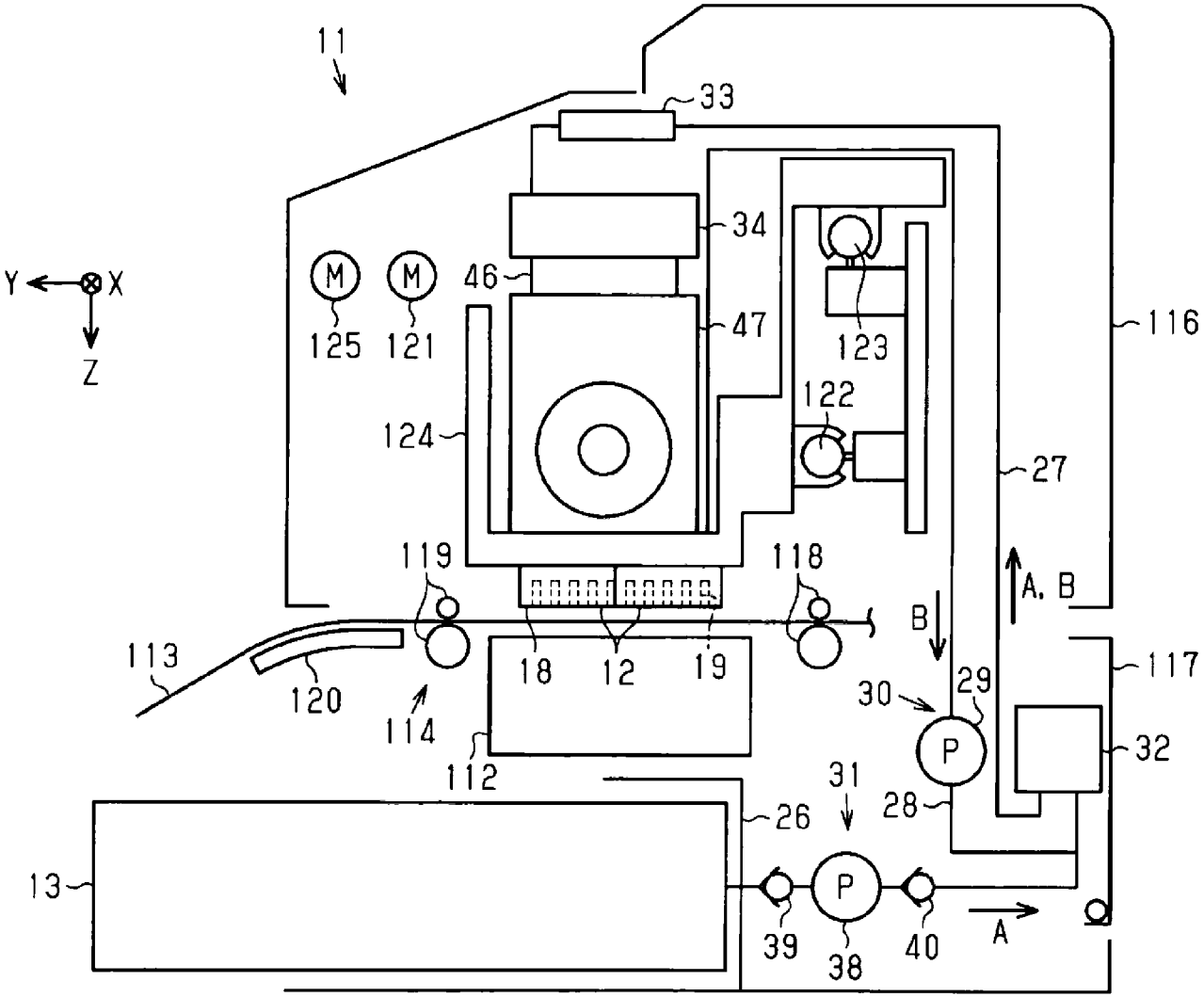
FIG. 1 is a side view schematically illustrating a droplet discharging apparatus.

As illustrated in FIG. 1, a droplet discharging apparatus 11 is provided with droplet dischargers 12 that discharge droplets, a supporting table 112 that supports a recording medium 113, and a transporter 114 that transports the recording medium 113 in a transportation direction Y. The droplet dischargers 12 discharge liquid, which is supplied from a liquid supply source 13, to the recording medium 113 in the form of droplets. The droplet dischargers 12 discharge droplets from a plurality of nozzles 19 formed in nozzle surfaces 18.

The droplet discharging apparatus 11 is provided with a guide shaft 122 and a guide shaft 123 that extend along a scanning axis X and a carriage 124 that is supported by the guide shaft 122 and the guide shaft 123. The droplet discharging apparatus 11 is provided with a carriage motor 125 that moves the carriage 124 along the guide shaft 122 and the guide shaft 123. The scanning axis X is an axis not parallel to the transportation direction Y and a vertical direction Z. The carriage 124 reciprocates along the guide shaft 122, the guide shaft 123, and the scanning axis X when the carriage motor 125 is driven.

The droplet dischargers 12 are installed in the carriage 124. The droplet dischargers 12 are attached to a lower end portion of the carriage 124 which is an end portion in the vertical direction Z. In the present embodiment, two droplet dischargers 12 are attached to the carriage 124. The two droplet dischargers 12 are, at the lower end portion of the carriage 124, disposed to be separated from each other in the scanning direction X by a predetermined distance and to be offset from each other in the transportation direction Y by a predetermined distance.

The droplet discharging apparatus 11 is configured as a serial type apparatus in which the droplet dischargers 12 reciprocate along the scanning axis X. The droplet discharging apparatus 11 may be configured as a line type apparatus in which the droplet dischargers 12 are provided to be elongated along the scanning axis X.

The supporting table 112 is disposed to face the droplet dischargers 12. The supporting table 112 is provided to extend along the scanning axis X. The supporting table 112, the transporter 114, the guide shaft 122, and the guide shaft 123 are assembled into a main body 116 that is configured of a housing, a frame, and the like. The main body 116 is provided with a cover 117 configured to be opened and closed.

The transporter 114 includes a pair of transportation rollers 118 that is positioned upstream of the supporting table 112 in the transportation direction Y and a pair of transportation rollers 119 that is positioned downstream of the supporting table 112 in the transportation direction Y. The transporter 114 includes a guide plate 120 that is positioned downstream of the pair of transportation rollers 119 in the transportation direction Y and that guides the recording medium 113. The transporter 114 includes a transportation motor 121 that causes the pair of transportation rollers 118 and the pair of transportation rollers 119 to rotate. The pair of transportation rollers 118 and the pair of transportation rollers 119 transport the recording medium 113 when being rotated with the transportation motor 121 being driven in a state where the recording medium 113 is interposed therebetween. At this time, the recording medium 113 is transported along a surface of the supporting table 112 and a surface of the guide plate 120 while being supported by the supporting table 112 and the guide plate 120. The transportation direction Y in the present embodiment is a direction in which the recording medium 113 on the supporting table 112 is transported.

Figure 2:
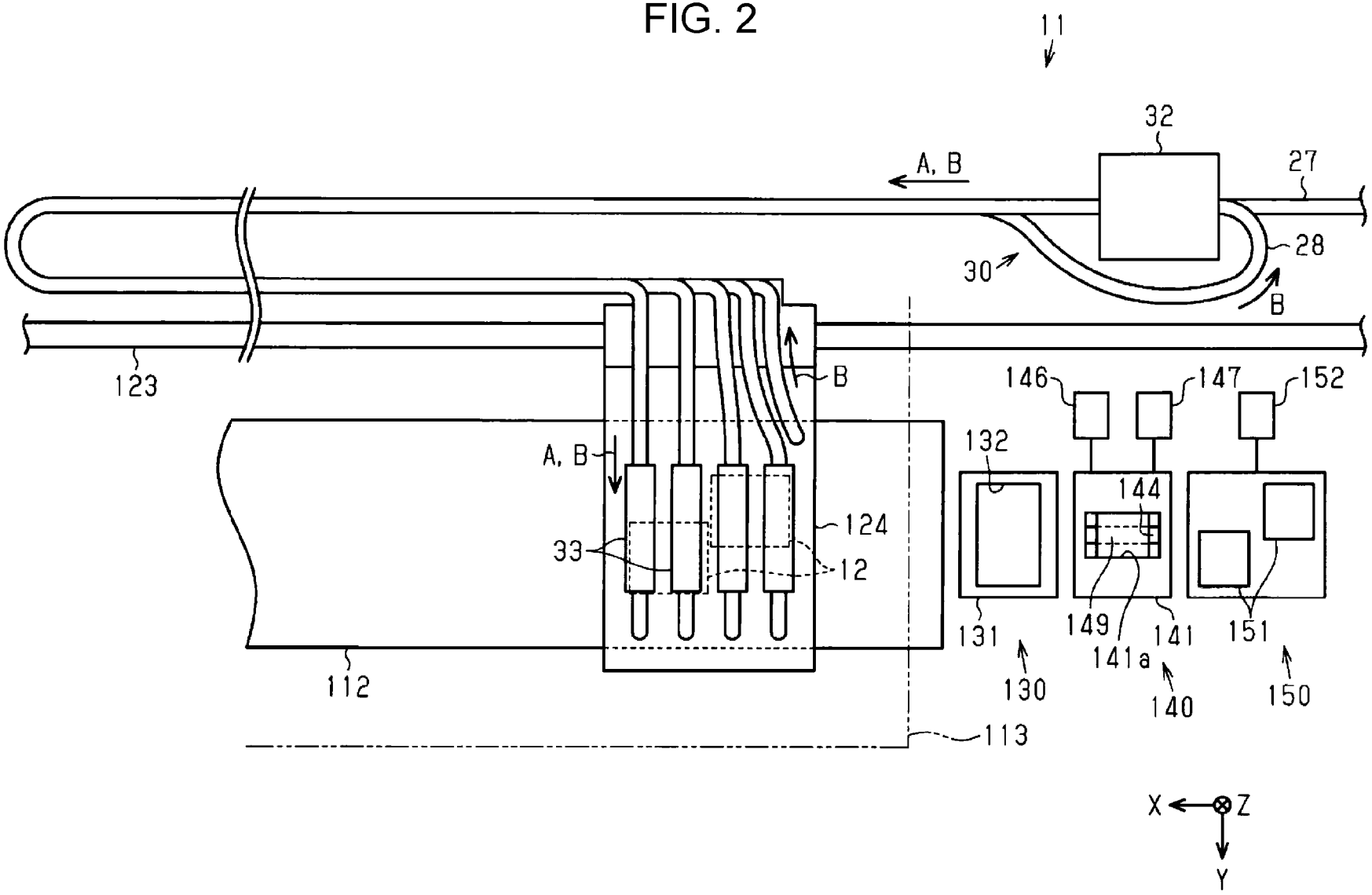
FIG. 2 is a plan view schematically illustrating an internal structure of the droplet discharging apparatus.

As illustrated in FIG. 2, the droplet discharging apparatus 11 may be provided with a flushing mechanism 130, a wiping mechanism 140, and a capping mechanism 150. In the present embodiment, the flushing mechanism 130, the wiping mechanism 140, and the capping mechanism 150 are provided in a non-recording region in the droplet discharging apparatus 11, the non-recording region being a region in which no droplets are discharged to the recording medium 113. The non-recording region in the present embodiment is a region in which the droplet dischargers 12 do not face the recording medium 113 in the middle of transportation, that is, a region adjacent to the supporting table 112 in a direction along the scanning axis X.

The flushing mechanism 130 includes a liquid receiver 131 receiving liquid that is discharged from the nozzles 19 of the droplet dischargers 12 due to a flushing operation. The flushing operation is an operation of discharging droplets not related to recording from the nozzles 19 in the purpose of preventing or resolving clogging or the like in the nozzles 19. The liquid receiver 131 is formed in a box shape. The liquid receiver 131 is provided with an opening 132 that is open toward a moving region of the carriage 124. The droplet dischargers 12 discharge droplets toward the opening 132 of the 131 at the time of the flushing operation.

Figure 3:
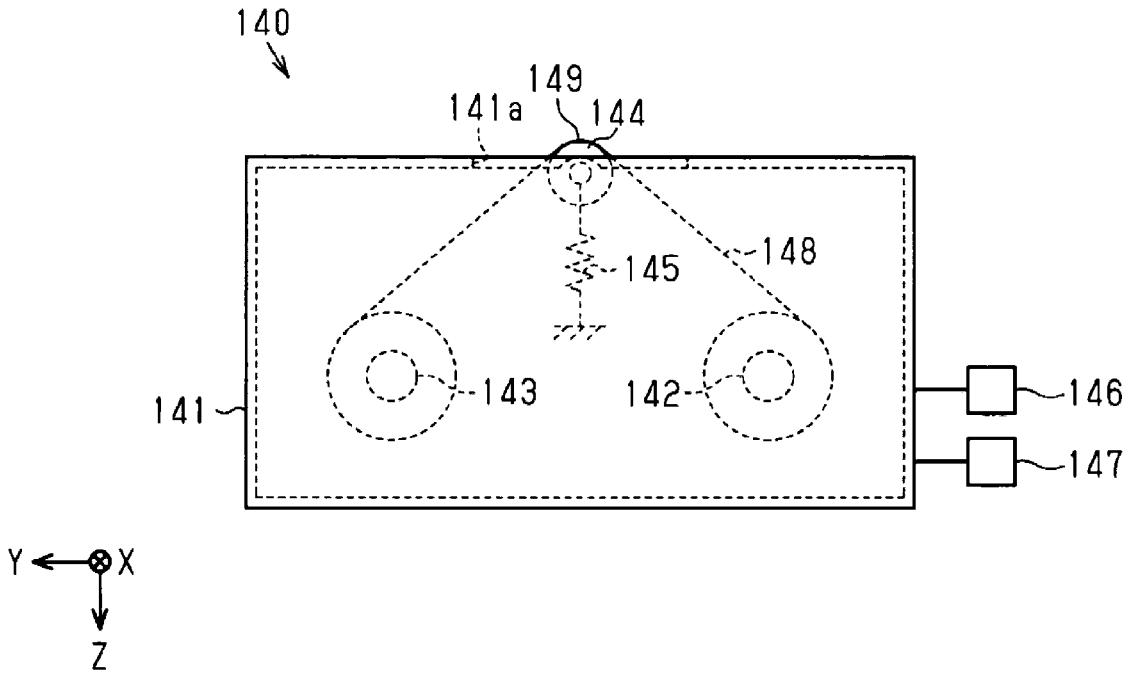
FIG. 3 is a side view of a wiping mechanism.

As illustrated in FIG. 3, the wiping mechanism 140 includes a casing 141, a feed roller 142, a winding roller 143, and an intermediate roller 144. An upper portion of the casing 141 is provided with an opening 141*a*. The feed roller 142 is positioned upstream in the transportation direction Y in the casing 141. The winding roller 143 is positioned downstream in the transportation direction Y in the casing 141. The intermediate roller 144 is positioned in the casing 141 such that the intermediate roller 144 is exposed through the opening 141*a*.

The wiping mechanism 140 includes a pressing member 145, a first wiper driving unit 146, and a second wiper driving unit 147. The pressing member 145 presses the intermediate roller 144 toward the outside of the casing 141. When the first wiper driving unit 146 is driven, the casing 141 moves in the transportation direction Y. When the second wiper driving unit 147 is driven, the casing 141 moves in the vertical direction Z. When the second wiper driving unit 147 moves the casing 141 in the vertical direction Z, an interval between the casing 141 and the nozzle surfaces 18 in the vertical direction Z is adjusted.

The feed roller 142, the winding roller 143, and the intermediate roller 144 are configured to rotate and are supported by the casing 141 such that axial directions thereof become parallel to each other. A fabric wiper 148 configured to absorb liquid is wound onto the feed roller 142 in a roll shape. When the feed roller 142 rotates, the fabric wiper 148 is fed from the feed roller 142. The fabric wiper 148 fed from the feed roller 142 is wound onto the intermediate roller 144 and wound onto the winding roller 143. When the winding roller 143 rotates, the fabric wiper 148 is wound onto the winding roller 143.

The wiping mechanism 140 is configured to wipe the nozzle surfaces 18. A wiping operation is an operation of wiping the nozzle surfaces 18 to remove foreign substances such as liquid and dust adhering to the nozzle surfaces 18. The wiping mechanism 140 wipes the nozzle surfaces 18 with a wiping portion 149, which is a portion of the fabric wiper 148 that is wound onto the intermediate roller 144.

The wiping mechanism 140 wipes the nozzle surfaces 18 in a state where the droplet dischargers 12 are positioned above the wiping mechanism 140. In the case of the wiping mechanism 140 according to the present embodiment, when the wiping operation is performed, first, the casing 141 moves with the second wiper driving unit 147 being driven and thus the wiping portion 149 comes into contact with the nozzle surfaces 18. Thereafter, the casing 141 moves with the first wiper driving unit 146 being driven and thus the wiping portion 149 wipes the nozzle surfaces 18. In this manner, the wiping mechanism 140 wipes the nozzle surfaces 18.

When the wiping mechanism 140 wipes the nozzle surfaces 18, the droplet dischargers 12 may move relative to the wiping mechanism 140 and both of the wiping mechanism 140 and the droplet dischargers 12 may move. When the wiping mechanism 140 wipes the nozzle surfaces 18, the wiping mechanism 140 and the droplet dischargers 12 move relative to each other.

When the winding roller 143 is rotated after liquid is absorbed by the wiping portion 149 due to the wiping operation, a portion of the fabric wiper 148 that has absorbed liquid is wound. Accordingly, a portion serving as the wiping portion 149 is changed from a portion of the fabric wiper 148 that has absorbed the liquid to a portion of the fabric wiper 148 that has not absorbed liquid.

As illustrated in FIG. 2, the capping mechanism 150 includes caps 151 that are configured to cap the nozzle surfaces 18 and a cap driving unit 152 that lifts and lowers the caps 151. A capping operation is an operation of causing the caps 151 to come into contact with the droplet dischargers 12 such that a space into which the nozzles 19 are open is formed. The caps 151 cap the nozzle surfaces 18 to cover openings of the nozzles 19. Accordingly, it is possible to suppress an increase in viscosity of liquid in the nozzles 19 which occurs when the liquid is dried.

The caps 151 may be configured to form closed spaces such that no fluid such as air or liquid enters or exits the caps 151 in a state where the nozzle surfaces 18 are capped. In this case, it is possible to further suppress the drying of liquid in the nozzles 19 by means of the capping operation.

The capping mechanism 150 includes a plurality of caps 151 corresponding to the number of droplet dischargers 12. In the present embodiment, the capping mechanism 150 includes two caps 151. The capping mechanism 150 caps the nozzle surfaces 18 of the two droplet dischargers 12 in a state where the two droplet dischargers 12 face the two caps 151 respectively.

In the case of the capping mechanism 150 according to the present embodiment, when the capping operation is performed, the cap driving unit 152 drives the two caps 151 such that the two caps 151 are lifted. Therefore, the two caps 151 come into contact with the nozzle surfaces 18 of the two droplet dischargers 12 such that the caps 151 cover the openings of all of the nozzles 19. As a result, the nozzle surfaces 18 of the droplet dischargers 12 are capped by the caps 151. That is, each cap 151 is configured to cap a region including all of the nozzles 19 in the nozzle surface 18 of each droplet discharger 12.

When the caps 151 cap the droplet dischargers 12, the droplet dischargers 12 may move relative to the capping mechanism 150 and both of the cap 151 and the droplet dischargers 12 may move. When the caps 151 cap the droplet dischargers 12, the cap 151 and the droplet dischargers 12 move relative to each other. Each of the caps 151 may include an atmosphere opening valve. The atmosphere opening valve is a valve that can cause the inside of the cap 151 and the atmosphere outside the cap 151 to communicate with each other in a state where the nozzle surface 18 is capped by the cap 151. Therefore, when the atmosphere opening valve is opened, a space inside the cap 151 is opened to the atmosphere.

Figure 4:
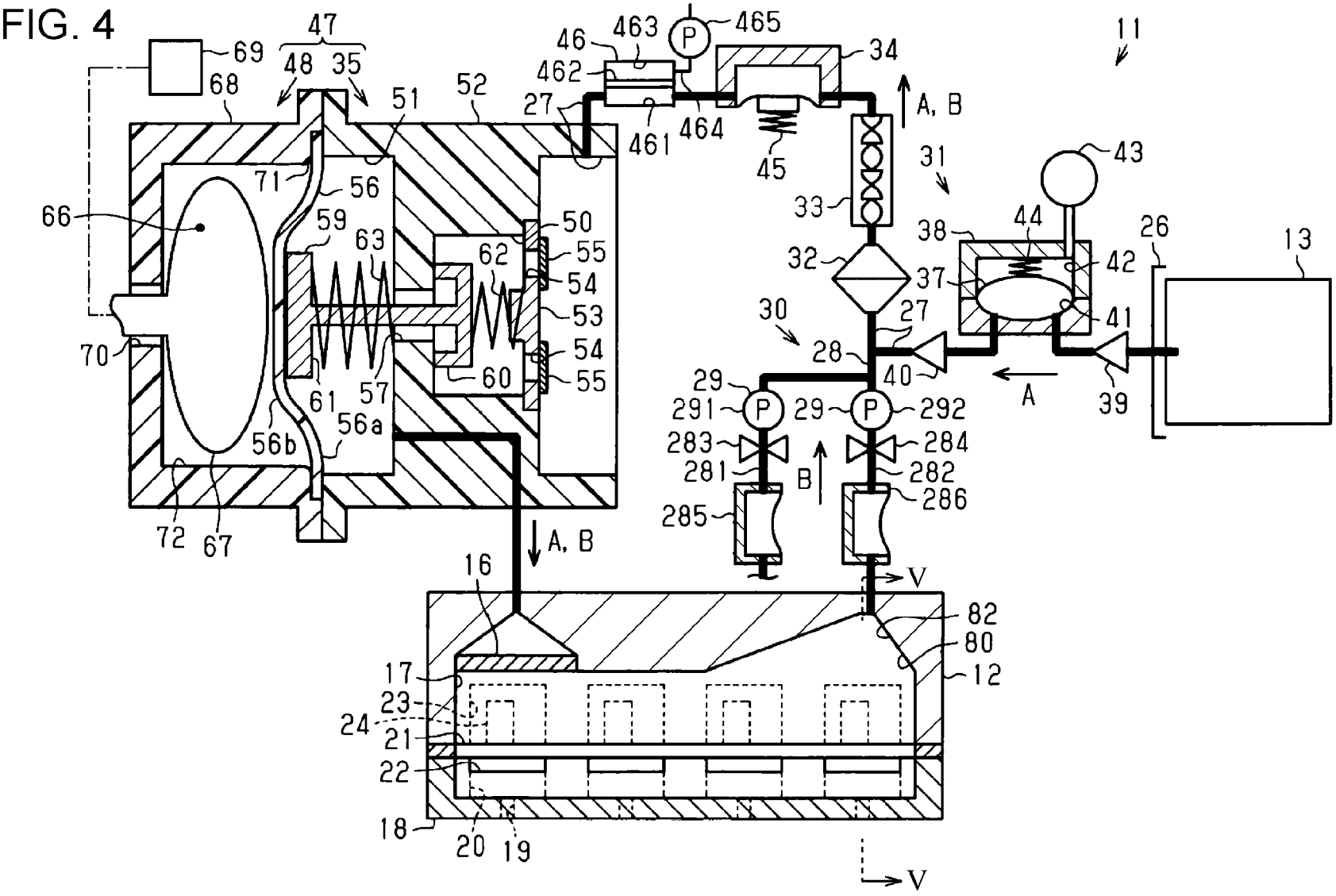
FIG. 4 is a sectional view schematically illustrating a pressure adjustment mechanism and a droplet discharger with an on-off valve closed.

As illustrated in FIG. 4, the droplet discharging apparatus 11 is provided with a liquid supply flow path 27 through which liquid is supplied from the liquid supply source 13 to the droplet discharger 12 and a return flow path 28 through which liquid returns to the liquid supply flow path 27 from the droplet discharger 12. The liquid supply flow path 27 is coupled to the liquid supply source 13 and the droplet discharger 12. The liquid supply flow path 27 is a flow path through which liquid is supplied from the liquid supply source 13, which is disposed upstream in a supply direction A of liquid, to the droplet discharger 12, which is disposed downstream in the supply direction A.

The return flow path 28 is coupled to the droplet discharger 12 and the liquid supply flow path 27. The return flow path 28 is coupled to an intermediate portion of the liquid supply flow path 27. The return flow path 28 forms a circulation path 30 for circulation of liquid together with the liquid supply flow path 27. That is, the circulation path 30 is configured to include the liquid supply flow path 27 and the return flow path 28. Liquid flowing through the circulation path 30 circulates through the droplet discharger 12, the liquid supply flow path 27, and the return flow path 28. The return flow path 28 is provided with circulation pumps 29 that circulate liquid. The circulation pumps 29 cause liquid to flow in a circulation direction B.

The liquid supply source 13 is, for example, a container configured to accommodate liquid. The liquid supply source 13 may be a replaceable cartridge or a tank to which liquid can be supplied. A plurality of the liquid supply sources 13, a plurality of the liquid supply flow paths 27, and a plurality of the return flow paths 28 are provided corresponding to the number of kinds of liquid discharged from the droplet dischargers 12. In the present embodiment, four liquid supply sources 13, four liquid supply flow paths 27, and four return flow paths 28 are provided. The droplet discharging apparatus 11 may be provided with a mounting portion 26 into which the liquid supply source 13 is mounted.

Figure 5:
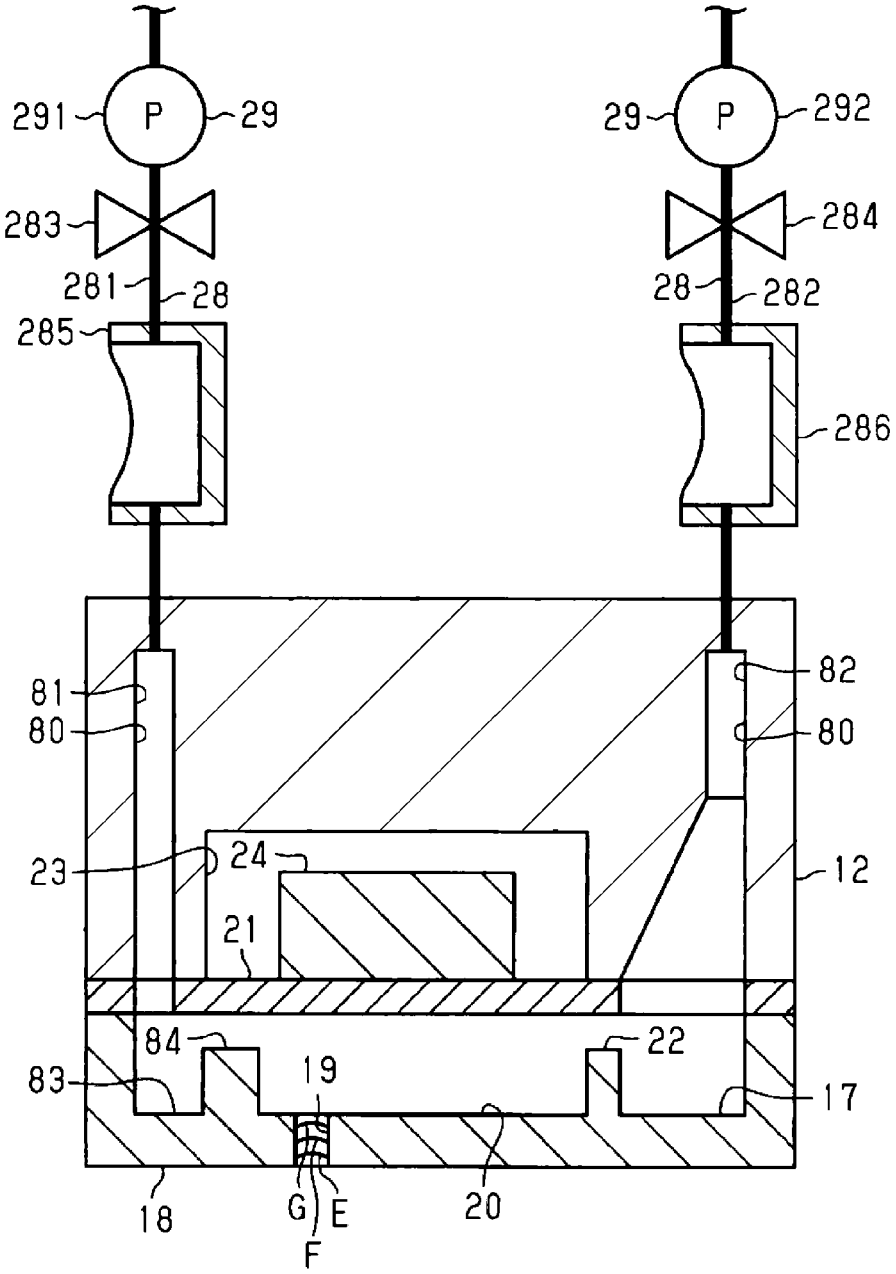
FIG. 5 is a sectional view taken along line V-V in FIG. 4.

As illustrated in FIGS. 4 and 5, the droplet discharger 12 is provided with a common liquid chamber 17 into which liquid is supplied. Liquid is supplied to the common liquid chamber 17 from the liquid supply source 13 via the liquid supply flow path 27. The liquid supply flow path 27 is coupled to the common liquid chamber 17. The common liquid chamber 17 may be provided with a filter 16 that captures air bubbles, foreign substances or the like in liquid supplied to the common liquid chamber 17. The common liquid chamber 17 stores liquid passing through the filter 16.

The droplet discharger 12 is provided with a plurality of pressure chambers 20 communicating with the common liquid chamber 17. The nozzles 19 are provided corresponding to the plurality of pressure chambers 20. The pressure chambers 20 communicate with the common liquid chamber 17 and the nozzles 19. A portion of a wall surface of the pressure chamber 20 is formed by a vibration plate 21. The common liquid chamber 17 and the pressure chambers 20 communicate with each other via a supply side communication path 22.

The droplet discharger 12 is provided with a plurality of actuators 24 provided corresponding to the plurality of pressure chambers 20. The actuators 24 are provided on a surface of the vibration plate 21 that is opposite to a portion facing the pressure chambers 20. Each actuator 24 is accommodated in an accommodation chamber 23 disposed at a different position from that of the common liquid chamber 17. The droplet discharger 12 discharges liquid in the pressure chambers 20 from the nozzles 19 in the form of droplets when the actuators 24 are driven. The droplet discharger 12 performs a recording process on the recording medium 113 by discharging droplets to the recording medium 113 from the nozzles 19.

In the present embodiment, a piezoelectric element which shrinks when a drive voltage is applied thereto constitutes each actuator 24. When application of a drive voltage to the actuators 24 is stopped after the vibration plate 21 is deformed due to the actuators 24 shrinking attributable to the drive voltage application, liquid in the pressure chambers 20 changed in volume is discharged from the nozzles 19 in the form of droplets.

The droplet discharger 12 includes a discharge flow path 80 through which liquid in the droplet discharger 12 is discharged to the outside without passing through the nozzles 19. The discharge flow path 80 is provided with a first discharge flow path 81 that is coupled to the pressure chambers 20 such that liquid in the pressure chambers 20 is discharged to the outside. Liquid flowing through the first discharge flow path 81 is discharged to the outsides of the pressure chambers 20 from the pressure chambers 20 without passing through the nozzles 19.

The droplet discharger 12 may include a discharge liquid chamber 83 communicating with the plurality of pressure chambers 20 and the first discharge flow path 81. In this case, the first discharge flow path 81 communicate with the plurality of pressure chambers 20 via the discharge liquid chamber 83. That is, the first discharge flow path 81 is indirectly coupled to the pressure chambers 20. The pressure chambers 20 and the discharge liquid chamber 83 communicate with each other via a discharge side communication path 84. Since the discharge liquid chamber 83 is provided, it is sufficient that one first discharge flow path 81 is provided for the plurality of pressure chambers 20. That is, since the discharge liquid chamber 83 is provided, it is not necessary to provide the first discharge flow path 81 for each pressure chamber 20. Therefore, it is possible to simplify the configuration of the droplet discharger 12. The droplet discharger 12 may be provided with a plurality of the first discharge flow paths 81 corresponding to the plurality of pressure chambers 20.

The droplet discharger 12 may include a second discharge flow path 82 that is coupled to the common liquid chamber 17 and the return flow path 28 such that liquid in the common liquid chamber 17 is discharged to the outside without passing through the pressure chambers 20. In this case, the discharge flow path 80 is provided with the first discharge flow path 81 and the second discharge flow path 82. That is, the droplet discharger 12 includes the first discharge flow path 81 and the second discharge flow path 82. The first discharge flow path 81 is the discharge flow path 80 coupled to the pressure chambers 20. The second discharge flow path 82 is the discharge flow path 80 coupled to the common liquid chamber 17.

The return flow path 28 may be provided with a first return flow path 281 coupled to the first discharge flow path 81 and a second return flow path 282 coupled to the second discharge flow path 82. The return flow path 28 in the present embodiment is configured such that the first return flow path 281 and the second return flow path 282 join each other. The return flow path 28 may be configured such that the first return flow path 281 and the second return flow path 282 do not join each other and may be configured such that the first return flow path 281 and the second return flow path 282 are coupled to the liquid supply flow path 27.

In the present embodiment, the circulation pump 29 is provided for each of the first return flow path 281 and the second return flow path 282. The first return flow path 281 is provided with a first circulation pump 291 as the circulation pump 29. The second return flow path 282 is provided with a second circulation pump 292 as the circulation pump 29.

The first return flow path 281 may be provided with a first on-off valve 283. In the first return flow path 281, the first on-off valve 283 is positioned between the first circulation pump 291 and the droplet discharger 12. When the first circulation pump 291 is driven with the first on-off valve 283 opened, liquid flows from the pressure chambers 20 to the liquid supply flow path 27 through the discharge liquid chamber 83 and the first return flow path 281.

The second return flow path 282 may be provided with a second on-off valve 284. In the second return flow path 282, the second on-off valve 284 is positioned between the second circulation pump 292 and the droplet discharger 12. When the second circulation pump 292 is driven with the second on-off valve 284 opened, liquid flows from the common liquid chamber 17 to the liquid supply flow path 27 through the second return flow path 282.

Only one circulation pump 29 may be provided in the first return flow path 281 and the second return flow path 282. In this case, the circulation pump 29 is disposed between a portion of the return flow path 28 at which the first return flow path 281 and the second return flow path 282 join each other and a portion of the return flow path 28 at which the return flow path 28 is connected to the liquid supply flow path 27. In this case, it is possible to cause liquid to flow through any of the first return flow path 281 and the second return flow path 282 by controlling the first on-off valve 283 and the second on-off valve 284.

In the first return flow path 281, a first damper 285 may be provided between the droplet discharger 12 and the first on-off valve 283. The first damper 285 is configured to store liquid. For example, one surface of the first damper 285 is formed as a flexible film and the first damper 285 is configured such that the volume of liquid stored in the first damper 285 can be changed. In the second return flow path 282, a second damper 286 having the same configuration as the first damper 285 may be provided between the droplet discharger 12 and the second on-off valve 284. In this case, it is possible to suppress, by means of a change in volume of the first damper 285 and the second damper 286, a fluctuation in pressure in the droplet discharger 12 which occurs when liquid flows through the first return flow path 281 and the second return flow path 282.

As illustrated in FIG. 4, the liquid supply flow path 27 is provided with a pressurizing mechanism 31, a filter unit 32, a static mixer 33, a liquid storing unit 34, a degasification mechanism 46, and a pressure adjustment device 47. In the liquid supply flow path 27, the pressurizing mechanism 31, the filter unit 32, the static mixer 33, the liquid storing unit 34, the degasification mechanism 46, and the pressure adjustment device 47 are disposed in this order in a direction from the liquid supply source 13 side which is positioned upstream to the droplet discharger 12 side which is positioned downstream.

The pressurizing mechanism 31 is positioned in the liquid supply flow path 27 while being positioned closer to the liquid supply source 13 side than a position at which the return flow path 28 is coupled to the liquid supply flow path 27. The filter unit 32, the static mixer 33, the liquid storing unit 34, the degasification mechanism 46, and the pressure adjustment device 47 are positioned in the liquid supply flow path 27 while being positioned closer to the droplet discharger 12 side than a position at which the return flow path 28 is coupled to the liquid supply flow path 27.

The pressurizing mechanism 31 causes liquid to flow in the supply direction A from the liquid supply source 13 such that the liquid is supplied to the droplet discharger 12. The pressurizing mechanism 31 includes a volume pump 38, an one-way valve 39, and an one-way valve 40. The volume pump 38 is configured to pressurize a predetermined amount of liquid by reciprocating a flexible member 37 which is flexible.

The volume pump 38 includes a pump chamber 41 and a negative pressure chamber 42. The volume pump 38 is partitioned into the pump chamber 41 and the negative pressure chamber 42 by the flexible member 37. Furthermore, the volume pump 38 includes a pressure reduction unit 43 that reduces the pressure in the negative pressure chamber 42 and a pressing member 44 that is provided in the negative pressure chamber 42 and urges the flexible member 37 toward the pump chamber 41 side.

The one-way valve 39 is positioned upstream of the volume pump 38 in the liquid supply flow path 27. The one-way valve 40 is positioned downstream of the volume pump 38 in the liquid supply flow path 27. The one-way valve 39 and the one-way valve 40 are configured to allow liquid to flow to downstream from upstream in the liquid supply flow path 27 and to inhibit liquid from flowing to the upstream from the downstream. That is, the pressurizing mechanism 31 can pressurize liquid to be supplied to the pressure adjustment device 47 with the pressing member 44 pressing liquid in the pump chamber 41 via the flexible member 37. Accordingly, a pressurizing force at which the pressurizing mechanism 31 pressurizes the liquid is set by means of a pressing force of the pressing member 44. In this regard, it can be said that the pressurizing mechanism 31 can pressurize liquid in the liquid supply flow path 27 in the present embodiment.

The filter unit 32 is configured to capture air bubbles and foreign substances in liquid. The filter unit 32 is provided to be replaceable. The static mixer 33 is configured to cause changes such as direction reversal or division in the flow of the liquid and reduce concentration bias in the liquid. The liquid storing unit 34 is configured to store liquid in a space with variable volume that is pressed by a spring 45 and alleviate a fluctuation in pressure of the liquid.

The degasification mechanism 46 includes a degasification chamber 461 in which liquid is temporarily stored, a pressure reduction chamber 463 that is separated from the degasification chamber 461 by a degasification film 462, a pressure reduction flow path 464 connected to the pressure reduction chamber 463, and a pump 465. The degasification film 462 has a property of allowing a gas to pass through the degasification film 462 and prevent liquid from passing through the degasification film 462. The degasification mechanism 46 decreases, by driving the pump 465, the pressure in the pressure reduction chamber 463 through the pressure reduction flow path 464 such that air bubbles, a resolved gas, and the like mixed in liquid stored in the degasification chamber 461 are removed. The degasification mechanism 46 may be configured to increase the pressure in the degasification chamber 461 such that air bubbles, a resolved gas, and the like mixed in liquid stored in the degasification chamber 461 are removed.

Next, the pressure adjustment device 47 will be described.

The pressure adjustment device 47 includes a pressure adjustment mechanism 35 that constitutes a portion of the liquid supply flow path 27 and a pressing mechanism 48 that presses the pressure adjustment mechanism 35. The pressure adjustment mechanism 35 includes a main body portion 52, in which a liquid inflow portion 50 into which liquid that is supplied from the liquid supply source 13 via the liquid supply flow path 27 flows and a liquid outflow portion 51 that can accommodate the liquid are formed.

The liquid supply flow path 27 and the liquid inflow portion 50 are separated from each other by a wall 53 of the main body portion 52 and communicate with each other via through holes 54 formed in the wall 53. The through holes 54 are covered by filter members 55. Therefore, liquid in the liquid supply flow path 27 flows into the liquid inflow portion 50 while being filtered by the filter members 55.

At least a portion of the wall portion of the liquid outflow portion 51 is configured of a diaphragm 56. A first surface **56*a* of the diaphragm 56, which is an inner surface of the liquid outflow portion 51, receives the pressure of liquid in liquid outflow portion 51. A second surface 56*b* of the diaphragm 56, which is an outer surface of the liquid outflow portion 51, receives atmospheric pressure. Therefore, the diaphragm 56 is displaced corresponding to the pressure in the liquid outflow portion 51. The volume of the liquid outflow portion 51 changes when the diaphragm 56 is displaced. The liquid inflow portion 50 and the liquid outflow portion 51 communicate with each other via a communication path 57**.

The pressure adjustment mechanism 35 includes an on-off valve 59 that can switch between a closed state in which the liquid inflow portion 50 and the liquid outflow portion 51 do not communicate with each other via the communication path 57 and an opened state in which the liquid inflow portion 50 and the liquid outflow portion 51 communicate with each other. The one-off valve 59 shown in FIG. 4 is in the closed state. The on-off valve 59 includes a valve portion 60 that can block the communication path 57 and a pressure receiving portion 61 that receives a pressure from the diaphragm 56. The on-off valve 59 moves when the pressure receiving portion 61 is pressed by the diaphragm 56. That is, the pressure receiving portion 61 also functions as a moving member that can move in a state of being in contact with the diaphragm 56 that is displaced in a direction in which the volume of the liquid outflow portion 51 is reduced.

An upstream pressing member 62 is provided in the liquid inflow portion 50. A downstream pressing member 63 is provided in the liquid outflow portion 51. The upstream pressing member 62 and the downstream pressing member 63 urge the on-off valve 59 in a direction in which the on-off valve 59 is closed. The state of the on-off valve 59 is changed to the opened state from the closed state when a pressure applied to the first surface **56*a* is lower than a pressure applied to the second surface 56*b* and a difference between the pressure applied to the first surface 56*a* and the pressure applied to the second surface 56*b*** is equal to or greater than a predetermined value. The predetermined value is, for example, 1 kPa.

The predetermined value is a value determined corresponding to the pressing force of the upstream pressing member 62, the pressing force of the downstream pressing member 63, a force required to displace the diaphragm 56, a sealing load which is a pressing force required to block the communication path 57 with the valve portion 60, the pressure in the liquid inflow portion 50 which acts on a surface of the valve portion 60, and the pressure in the liquid outflow portion 51. That is, the predetermined value for switch from the closed state to the opened state increases as the pressing forces of the upstream pressing member 62 and the downstream pressing member 63 increase.

The pressing forces of the upstream pressing member 62 and the downstream pressing member 63 are set such that the pressure in the liquid outflow portion 51 becomes a negative pressure at which a meniscus can be formed on a gas-liquid interface in the nozzle 19. For example, when a pressure applied to the second surface 56*b* is atmospheric pressure, the pressing forces of the upstream pressing member 62 and the downstream pressing member 63 are set such that the pressure in the liquid outflow portion 51 becomes −1 kPa. In this case, the gas-liquid interface is a boundary at which the liquid and the gas are in contact with each other and the meniscus is a curved liquid surface which is generated when liquid comes into contact with the nozzle 19. In addition, it is preferable that a concave meniscus suitable for droplet discharge be formed in the nozzle 19.

In the present embodiment, when the on-off valve 59 in the pressure adjustment mechanism 35 is in the closed state, the pressure of liquid positioned upstream of the pressure adjustment mechanism 35 generally becomes a positive pressure due to the pressurizing mechanism 31. Specifically, when the on-off valve 59 is in the closed state, the pressure of liquid in the liquid inflow portion 50 and the pressure of liquid positioned upstream of the liquid inflow portion 50 generally become a positive pressure due to the pressurizing mechanism 31.

In the present embodiment, when the on-off valve 59 in the pressure adjustment mechanism 35 is in the closed state, the pressure of liquid positioned downstream of the pressure adjustment mechanism 35 generally becomes a negative pressure due to the diaphragm 56. Specifically, when the on-off valve 59 is in the closed state, the pressure of liquid in the liquid outflow portion 51 and the pressure of liquid positioned downstream of the liquid outflow portion 51 generally become a negative pressure due to the diaphragm 56.

When the droplet discharger 12 discharges droplets, liquid accommodated in the liquid outflow portion 51 is supplied to the droplet discharger 12 via the liquid supply flow path 27. As a result, the pressure in the liquid outflow portion 51 is reduced. When a difference between a pressure applied to the first surface 56*a* of the diaphragm 56 and a pressure applied to the second surface 56*b* becomes equal to or greater than the predetermined value due to the above-described pressure reduction, the diaphragm 56 is bent and deformed in a direction in which the volume of the liquid outflow portion 51 is reduced. When the pressure receiving portion 61 is pressed and moved in accordance with the deformation of the diaphragm 56, the on-off valve 59 enters the opened state.

When the on-off valve 59 enters the opened state, since the liquid in the liquid inflow portion 50 is pressurized by the pressurizing mechanism 31, liquid is supplied to the liquid outflow portion 51 from the liquid inflow portion 50. As a result, the pressure in the liquid outflow portion 51 increases. When the pressure in the liquid outflow portion 51 increases, the diaphragm 56 is deformed such that the volume of the liquid outflow portion 51 increases. When the difference between the pressure applied to the first surface 56*a* of the diaphragm 56 and the pressure applied to the second surface 56*b* becomes lower than the predetermined value, the state of the on-off valve 59 changes to the closed state from the opened state. As a result, the on-off valve 59 inhibits liquid from flowing to the liquid outflow portion 51 from the liquid inflow portion 50.

As described above, the pressure adjustment mechanism 35 adjusts the pressure of liquid supplied to the droplet discharger 12 by means of displacement of the diaphragm 56 in order to adjust the pressure in the droplet discharger 12 in which the nozzle 19 causes a back pressure.

The pressing mechanism 48 includes an expansion and contraction portion 67 that forms a pressure adjustment chamber 66 which is positioned close to the second surface 56*b* of the diaphragm 56, a retaining member 68 that retains the expansion and contraction portion 67, and a pressure adjustment unit 69 that can adjust the pressure in the pressure adjustment chamber 66. The expansion and contraction portion 67 is formed of rubber or resin and is formed into a balloon-like shape. The expansion and contraction portion 67 expands or contracts in response to adjustment of the pressure in the pressure adjustment chamber 66 which is performed by the pressure adjustment unit 69. The retaining member 68 is formed in a bottomed cylindrical shape. A portion of the expansion and contraction portion 67 is inserted into an insertion hole 70 formed in the bottom portion of the retaining member 68.

An end edge portion of an inner surface of the retaining member 68 that is on an opening portion 71 side is given roundness through R-chamfering. The retaining member 68 is attached to the pressure adjustment mechanism 35 such that the opening portion 71 is blocked by the pressure adjustment mechanism 35. Therefore, the retaining member 68 forms an air chamber 72 that covers the second surface 56*b* of the diaphragm 56. The pressure in the air chamber 72 is set to atmospheric pressure. Therefore, the atmospheric pressure acts on the second surface 56*b* of the diaphragm 56.

The pressure adjustment unit 69 causes the expansion and contraction portion 67 to expand by adjusting the pressure in the pressure adjustment chamber 66 to be higher than the atmospheric pressure which is the pressure in the air chamber 72. The pressing mechanism 48 presses the diaphragm 56 in a direction in which the volume of the liquid outflow portion 51 is reduced with the pressure adjustment unit 69 causing the expansion and contraction portion 67 to expand. At this time, the expansion and contraction portion 67 of the pressing mechanism 48 presses a portion of the diaphragm 56 that comes into contact with the pressure receiving portion 61. The area of the portion of the diaphragm 56 that comes into contact with the pressure receiving portion 61 is greater than the cross-sectional area of the communication path 57.

Figure 6:
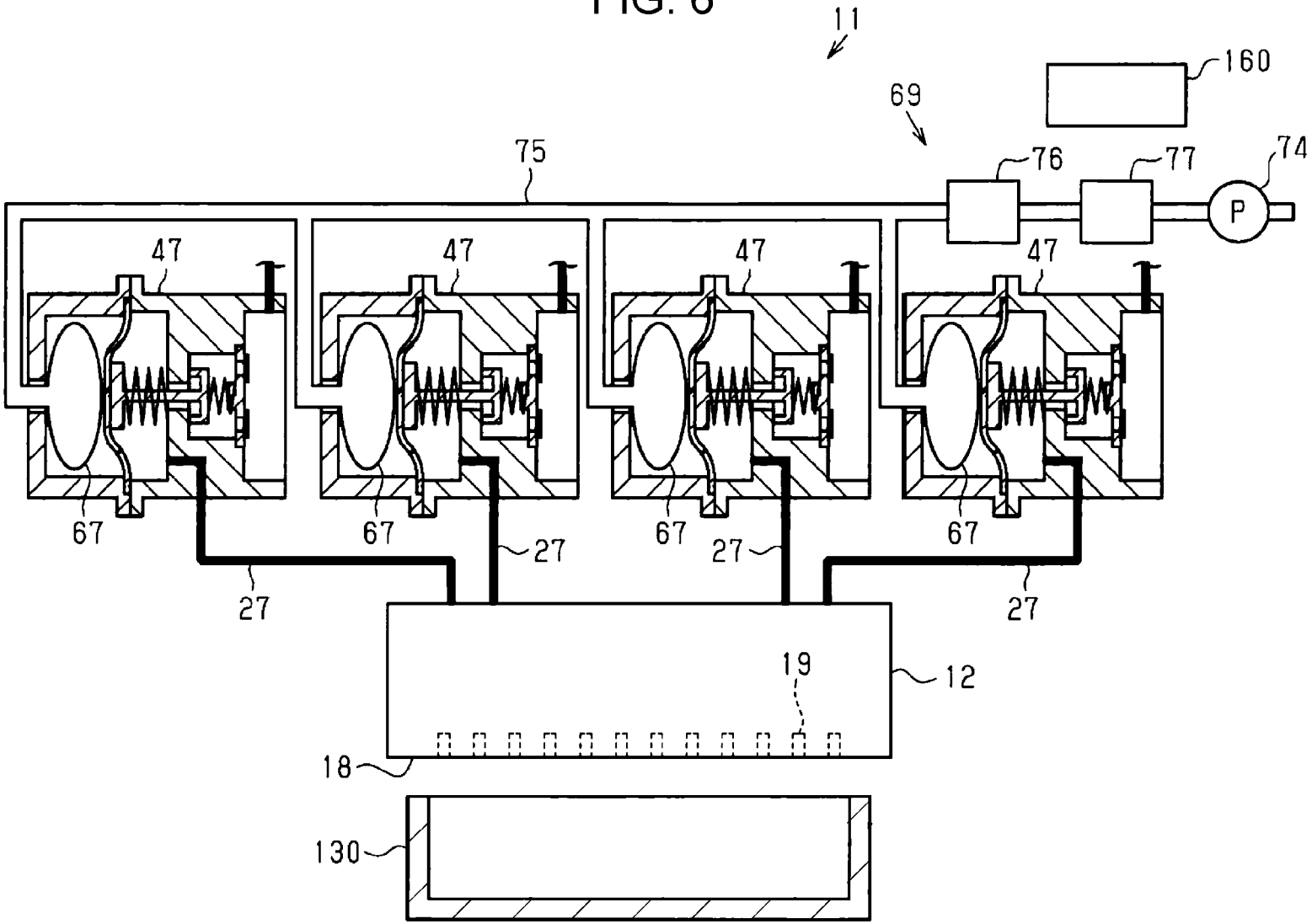
FIG. 6 is a sectional view schematically illustrating a plurality of pressure adjustment mechanisms and a pressure adjustment unit.

As illustrated in FIG. 6, the pressure adjustment unit 69 includes a pressurizing pump 74 that pressurizes fluid such as air or water and a coupling path 75 that couples the pressurizing pump 74 and the expansion and contraction portions 67 to each other. The pressure adjustment unit 69 includes a pressure measurer 76 that measures the pressure of fluid in the coupling path 75 and a fluid pressure adjustment unit 77 that adjusts the pressure of fluid in the coupling path 75.

The coupling path 75 branches into a plurality of flow paths and the flow paths are respectively coupled to the expansion and contraction portions 67 of a plurality of the pressure adjustment devices 47. In the present embodiment, the 75 branches into four flow paths and the four flow paths are respectively coupled to the expansion and contraction portions 67 of four pressure adjustment devices 47. Fluid pressurized by the pressurizing pump 74 is supplied to each of the expansion and contraction portions 67 via the coupling path 75. A changeover valve that switches the state of a flow path between an opened state and a closed state may be provided for each of the plurality of branches of the coupling path 75. In this case, it is possible to selectively supply the pressurized fluid to the plurality of expansion and contraction portions 67 by controlling the changeover valves.

The fluid pressure adjustment unit 77 is configured of, for example, a safety valve. The fluid pressure adjustment unit 77 is configured to be automatically opened when the pressure of fluid in the coupling path 75 becomes higher than a predetermined pressure. When the fluid pressure adjustment unit 77 is opened, the fluid in the coupling path 75 is discharged to the outside. In this manner, the fluid pressure adjustment unit 77 reduces the pressure of fluid in the coupling path 75.

Next, the electrical configuration of the droplet discharging apparatus 11 will be described.

Figure 7:
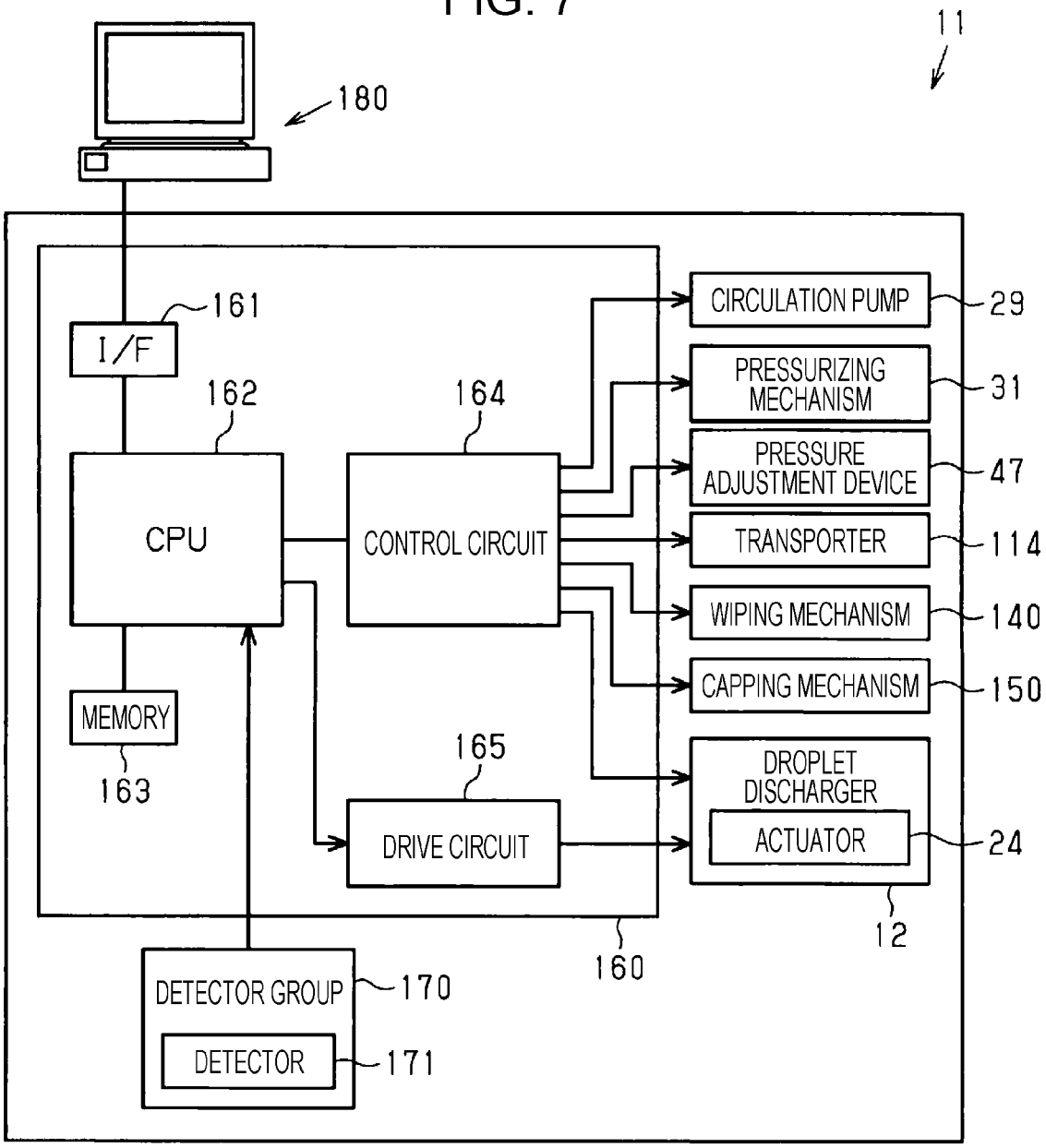
FIG. 7 is a block diagram illustrating an electrical configuration of the droplet discharging apparatus.

As illustrated in FIG. 7, the droplet discharging apparatus 11 is provided with a controller 160 that collectively controls constituent elements of the droplet discharging apparatus 11 and a detector group 170 controlled by the controller 160. The detector group 170 includes a detector 171 that detects the state of the insides of the pressure chambers 20 by detecting the vibration waveforms of the pressure chambers 20. The detector group 170 monitors a situation in the droplet discharging apparatus 11. The detector group 170 outputs the result of the detection to the controller 160.

The controller 160 includes an interface unit 161, a CPU 162, a memory 163, a control circuit 164, and a drive circuit 165. The interface unit 161 transmits and receives data between a computer 180, which is an external device, and the droplet discharging apparatus 11. The drive circuit 165 generates a drive signal to drive the actuators 24.

The CPU 162 is a calculation processing device. The memory 163 is a storing device that secures a region storing a program for the CPU 162 or a working region and includes a storing element such as a RAM, an EEPROM, or the like. The CPU 162 controls, based on a program stored in the memory 163, the circulation pumps 29, the pressurizing mechanism 31, the pressure adjustment devices 47, the transporter 114, the wiping mechanism 140, the capping mechanism 150, the droplet dischargers 12, and the like via the control circuit 164.

The detector group 170 includes, for example, a linear encoder that detects the state of movement of the carriage 124, a medium detecting sensor that detects the recording medium 113, and the detector 171 which is a circuit detecting residual vibration of the pressure chambers 20. The controller 160 performs nozzle inspection, which will be described later, based on the result of detection performed by the detector 171. The detector 171 may include piezoelectric elements constituting the actuators 24.

Next, the nozzle inspection will be described.

When voltage is applied to the actuators 24 through a signal from the drive circuit 165, the vibration plate 21 is bent and deformed. Accordingly, there is a fluctuation in pressure in the pressure chambers 20. Due to the fluctuation, the vibration plate 21 vibrates for a while. This vibration is called residual vibration. Detecting the state of the pressure chambers 20 and the nozzles 19 communicating with the pressure chambers 20 from the state of the residual vibration will be referred to as the nozzle inspection.

Figure 8:
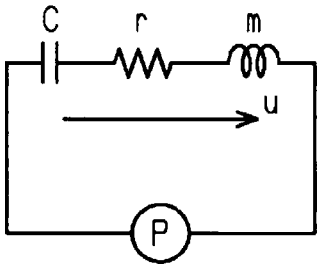
FIG. 8 is a diagram showing a simple harmonic motion calculation model made in consideration of residual vibration of a vibration plate.

FIG. 8 is a diagram showing a simple harmonic motion calculation model made in consideration of the residual vibration of the vibration plate 21.

When the drive circuit 165 applies a drive signal to the actuators 24, the actuators 24 expand and contract corresponding to the voltage of the drive signal. The vibration plate 21 is bent corresponding to the expansion and contraction of the actuators 24. Accordingly, the volume of the pressure chambers 20 is decreased after being increased. At this time, due to a pressure generated in the pressure chambers 20, a portion of liquid filling the pressure chambers 20 is discharged from the nozzles 19 in the form of droplets.

At the time of the above-described series of actions of the vibration plate 21, the vibration plate 21 free-vibrates at a natural vibration frequency which is determined by a flow path resistance r, an inertance m, and the compliance C of the vibration plate 21. The flow path resistance r is determined by the shape of a flow path in which liquid flows, the viscosity of the liquid, and the like and the inertance m is determined by the weight of liquid in the flow path. The free vibration of the vibration plate 21 is the residual vibration of the vibration plate 21.

The residual vibration calculation model of the vibration plate 21 which is shown in FIG. 8 can be represented with a pressure P, the inertance m, the compliance C, and the flow path resistance r. When step response at a time when the pressure P is applied to a circuit in FIG. 8 is calculated with respect to a volume velocity u, the following equations are obtained.

$$u = \frac{P}{\omega \cdot m} e^{-\omega t} \cdot \sin \omega t \tag{1}$$

$$\omega = \sqrt{\frac{1}{m \cdot C} - a^2} \tag{2}$$

$$\alpha = \frac{r}{2m} \tag{3}$$

Figure 9:
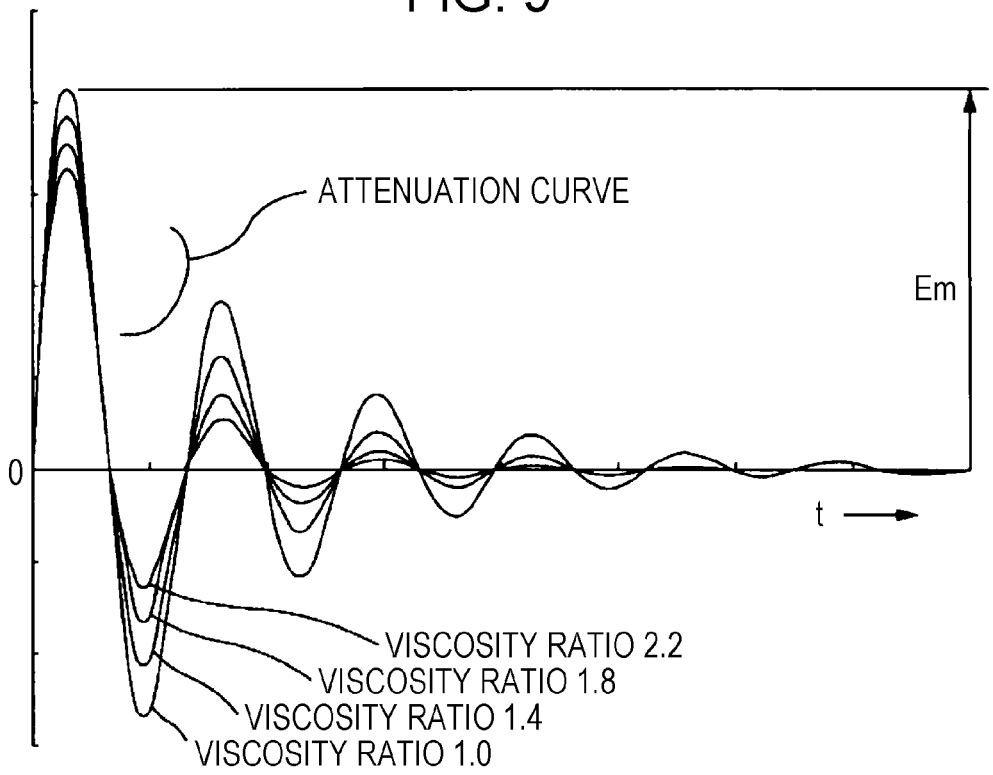
FIG. 9 is a diagram for describing a relationship between an increase in viscosity of liquid and a residual vibration waveform.

FIG. 9 is a diagram for describing a relationship between an increase in viscosity of liquid and a residual vibration waveform. The horizontal axis in FIG. 9 represents time and the vertical axis represents the magnitude of residual vibration. For example, when liquid near the nozzle 19 is dried, the viscosity of the liquid is increased. When the viscosity of the liquid is increased, the flow path resistance r increases and thus the vibration cycle and attenuation of residual vibration become great.

Figure 10:
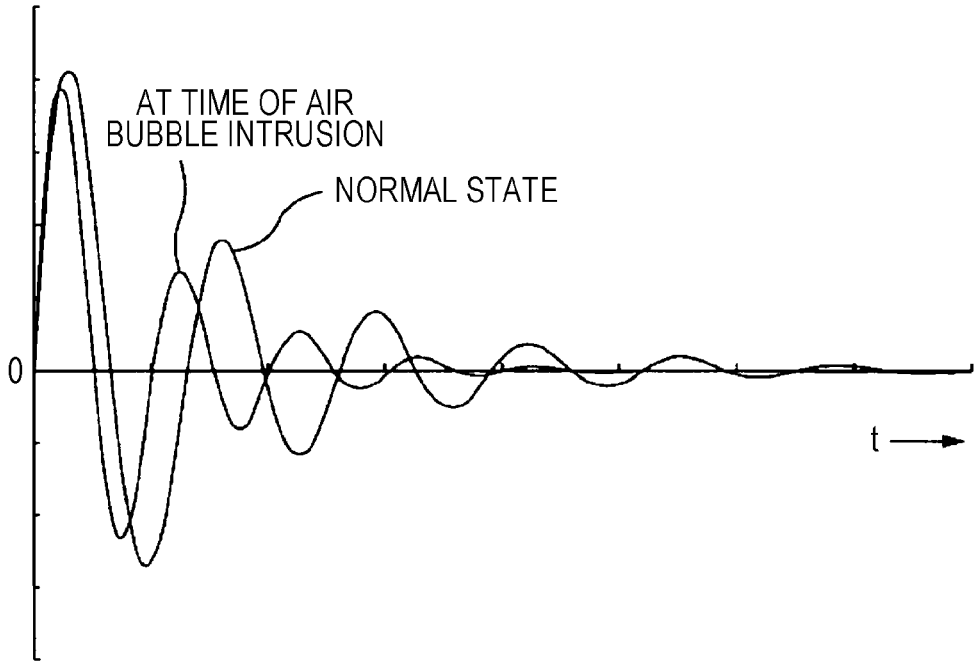
FIG. 10 is a diagram for describing a relationship between air bubble intrusion and the residual vibration waveform.

FIG. 10 is a diagram for describing a relationship between air bubble intrusion and the residual vibration waveform. The horizontal axis in FIG. 10 represents time and the vertical axis represents the magnitude of residual vibration. For example, when air bubbles intrude into a liquid flow path or a tip end of the nozzle 19, the inertance m, which is the weight of liquid, decreases corresponding to the air bubble intrusion in comparison with a case where the nozzle 19 is in a normal state. As the inertance m decreases, an angular velocity co increases as understood from Equation (2) and thus the vibration cycle becomes short. That is, the vibration frequency becomes great.

In addition, it is considered that the amount of liquid in the pressure chambers 20 and the amount of liquid corresponding to seepage are increased in comparison with a normal state as seen from the vibration plate 21 such that the inertance m is increased when foreign substances such as paper dust adheres to the vicinity of openings of the nozzles 19. It is considered that the flow path resistance r is increased due to fibers of the paper dust adhering to the vicinity of outlets of the nozzles 19. Therefore, when paper dust adheres to the vicinity of the openings of the nozzles 19, a frequency becomes lower in comparison with a case where liquid is discharged normally and becomes higher in comparison with a case where the viscosity of the liquid is increased.

When an increase in viscosity of liquid, intrusion of air bubbles, adhesion of foreign substances, or the like occurs, the state of the insides of the nozzles 19 and the state of the insides of the pressure chambers 20 become abnormal and thus liquid becomes not able to be discharged from the nozzles 19 in a typical manner. Therefore, dot omission on an image recorded onto the recording medium 113 occurs. Even if droplets are discharged from the nozzles 19, the amounts of droplets may be small or the droplets may not be landed on target positions due to flying direction deviation of the droplets. The nozzle 19 with such a discharge failure will be referred to as an abnormal nozzle.

As described above, the residual vibration of the pressure chamber 20 communicating with an abnormal nozzle is different from the residual vibration of the pressure chamber 20 communicating with the nozzle 19 in a normal state. Therefore, the detector 171 detects the state of the inside of the pressure chamber 20 by detecting the vibration waveform of the pressure chamber 20. The controller 160 performs inspection of the nozzle 19 based on the result of the detection performed by the detector 171.

The controller 160 may estimate whether the state of the inside of the pressure chamber 20 is normal or abnormal based on the vibration waveform of the pressure chamber 20, which is the result of the detection performed by the detector 171. When the state of the inside of the pressure chamber 20 is abnormal, the nozzle 19 communicating with the pressure chamber 20 is estimated as an abnormal nozzle. The controller 160 may estimate, based on the vibration waveform of the pressure chamber 20, whether the state of the inside of the pressure chamber 20 is abnormal due to air bubbles present therein or the state of the inside of the pressure chamber 20 is abnormal due to an increase in viscosity of liquid. The controller 160 may estimate, based on the vibration waveform of the pressure chamber 20, the total volume of air bubbles present in the pressure chamber 20 and the nozzle 19 communicating with the pressure chamber 20 and the degree to which liquid in the pressure chamber 20 and the nozzle 19 communicating with the pressure chamber 20 is increased in viscosity.

The frequency of a vibration waveform that is detected in a state where air bubbles are present in the pressure chamber 20 and the nozzle 19 filled with liquid is higher than the frequency of a vibration waveform that is detected in a state where air bubbles are not present in the pressure chamber 20 and the nozzle 19 filled with liquid. The frequency of a vibration waveform that is detected in a state where the pressure chamber 20 and the nozzle 19 are filled with air is higher than the frequency of a vibration waveform that is detected in a state where air bubbles are present in the pressure chamber 20 and the nozzle 19 filled with liquid. The larger the air bubbles present in the pressure chamber 20 and the nozzle 19 filled with liquid, the higher the frequency of the vibration waveform is.

When liquid becomes stagnant in the droplet discharging apparatus 11, the liquid becomes likely to be increased in viscosity or air bubbles become likely to be accumulated. In this case, there is a high possibility of an abnormal nozzle. That is, the state of the insides of the pressure chambers 20 is likely to be abnormal. Therefore, the droplet discharging apparatus 11 is configured to perform a maintenance operation of performing maintenance of the droplet discharger 12 in order to suppress an increase in viscosity of liquid or discharge air bubbles. The droplet discharging apparatus 11 in the present embodiment is configured to perform a first discharge operation, a second discharge operation, a third discharge operation, a fourth discharge operation, and a fifth discharge operation as the maintenance operation for the droplet discharger 12.

The droplet discharging apparatus 11 performs, as the maintenance operation for the droplet discharger 12, the first discharge operation of causing liquid in the pressure chambers 20 to be discharged toward the return flow path 28 via the discharge flow path 80 coupled to the pressure chambers 20 when no droplets are discharged from the nozzles 19 during a recording process. The first discharge operation is an operation of causing liquid in the pressure chambers 20 to be discharged toward the return flow path 28 via the first discharge flow path 81.

A time when no droplets are discharged from the nozzles 19 during the recording process is, for example, a returning time of the carriage 124 or an inter-page time of the recording medium 113. The returning time of the carriage 124 is a time at which the carriage 124 moves to return to a home position. The inter-page time of the recording medium 113 is a time between when an image is recorded on the recording medium 113 and when the next recording medium 113 reaches a position facing the droplet dischargers 12. The droplet discharging apparatus 11 performs the first discharge operation at such a time.

In the droplet discharger 12 in the middle of the recording process, the nozzles 19 used for recording and the nozzles 19 not used for the recording are present. In the nozzles 19 used for the recording and the pressure chambers 20 communicating with the nozzles 19, liquid is less likely to be increased in viscosity since the liquid is discharged from the nozzles 19. In the nozzles 19 not used for the recording and the pressure chambers 20 communicating with the nozzles 19, liquid becomes stagnant and is likely to be increased in viscosity since the liquid is not discharged from the nozzles 19.

In order to suppress an increase in viscosity of liquid, generally, the flushing operation is performed. If the flushing operation is performed at a time when no droplets are discharged from the nozzles 19 during the recording process, that is, at the returning time of the carriage 124 or the inter-page time of the recording medium 113, an increase in viscosity of liquid in the droplet discharger 12 can be suppressed. When the flushing operation is performed, droplets are discharged from the nozzles 19 and thus liquid is consumed. When the flushing operation is performed for each time the recording process is performed in order to suppress an increase in viscosity of liquid, the amount of liquid consumed becomes large.

When the droplet discharging apparatus 11 performs the first discharge operation, liquid discharged from the pressure chambers 20 to the return flow path 28 via the discharge flow path 80 coupled to the pressure chambers 20 flows in the circulation path 30. Since the liquid flows, an increase in viscosity of the liquid is suppressed. Therefore, by using the first discharge operation, it is possible to suppress an increase in viscosity of liquid without discharging droplets from the nozzles 19. Therefore, it is possible to reduce the amount of liquid consumed for maintenance.

In the first discharge operation, the droplet discharging apparatus 11 may cause liquid to be discharged toward the return flow path 28 with the liquid in the pressure chambers 20 sucked from the discharge flow path 80 side such that meniscuses on gas-liquid interfaces in the nozzles 19 are maintained. The droplet discharging apparatus 11 in the present embodiment performs the first discharge operation by driving the circulation pumps 29. When the first discharge operation is performed with the liquid in the pressure chambers 20 sucked from the discharge flow path 80 side, the meniscuses on the gas-liquid interfaces in the nozzles 19 are moved toward the pressure chambers 20. That is, liquid in the nozzles 19 flows. Therefore, an increase in viscosity of the liquid in the nozzles 19 can be suppressed.

The droplet discharging apparatus 11 may be configured to cause liquid in the pressure chambers 20 to be discharged toward the return flow path 28 by pressurizing the liquid in the pressure chambers 20 from the liquid supply flow path 27 side. In this case, the liquid may be pressurized at such a pressure that the liquid does not flow out through the nozzles 19.

The droplet discharging apparatus 11 may perform the first discharge operation when it is estimated, based on the result of the detection performed by the detector 171, that the state of the insides of the pressure chambers 20 is abnormal since the volume of air bubbles present in the pressure chambers 20 and the nozzles 19 is equal to or greater than a set value. The set value is stored in the memory 163 of the controller 160. The memory 163 stores the vibration waveform that is detected by the detector 171 when the volume of air bubbles present in the pressure chamber 20 and the nozzle 19 is equal to the set value.

When the volume of air bubbles present in the pressure chambers 20 and the nozzles 19 is small, the air bubbles may be eliminated by being dissolved in liquid with time. When the volume of the air bubbles is small, it is possible to remove the air bubbles from the pressure chambers 20 and the nozzles 19 without performing the first discharge operation by, for example, waiting for a predetermined time. On the contrary, when the volume of air bubbles present in the pressure chambers 20 and the nozzles 19 is large, the air bubbles may grow with time. Therefore, the set value is a value that indicates the minimum volume of air bubbles estimated not to be eliminated with time.

The droplet discharging apparatus 11 performs the first discharge operation when the air bubbles are not estimated to be eliminated with time. In this case, it is not necessary to perform the first discharge operation when the air bubbles are estimated to be eliminated with time. Therefore, it is possible to decrease a frequency at which the first discharge operation is performed.

When the first discharge operation is not performed since the air bubbles are estimated to be eliminated, the nozzle 19 in an abnormal state caused by the air bubbles may not be able to be used for the recording until the air bubbles are eliminated. Therefore, when the recording process is continued without performing the first discharge operation, a complementary recording operation of compensating for droplets to be discharged from the nozzle 19 in an abnormal state by means of droplets discharged from the nozzle 19 in a normal state may be performed.

For example, when one of the plurality of nozzles 19 discharging the same kind of droplet is in an abnormal state, droplets larger than droplets to be discharged from the nozzle 19 in the abnormal state are discharged from the nozzle 19 in the normal state that is positioned near the nozzle 19 in the abnormal state such that dot omission is compensated. For example, when the nozzle 19 discharging black ink is in an abnormal state, yellow, cyan, and magenta droplets are discharged in a superimposed manner to a position to which droplets to be discharged from the nozzle 19 is to be landed such that dot omission of black ink is compensated.

The droplet discharging apparatus 11 may estimate whether the state of the insides of the pressure chambers 20 is improved or not by comparing the vibration waveforms of the pressure chambers 20 that are detected by the detector 171 at intervals and when it is estimated that the state of the insides of the pressure chambers 20 is not improved, the droplet discharging apparatus 11 may perform, as the maintenance operation for the droplet discharger 12, the second discharge operation of causing liquid in the pressure chambers 20 to be discharged to the outside from the nozzles 19. The second discharge operation is the flushing operation.

For example, when the state of the insides of the pressure chambers 20 is not improved even after the first discharge operation is performed, the droplet discharging apparatus 11 performs the second discharge operation of causing liquid in the pressure chambers 20 to be discharged to the outside from the nozzles 19. In this case, the droplet discharging apparatus 11 detects the state of the insides of the pressure chambers 20 again with the detector 171 after the first discharge operation is performed based on the result of the detection performed by the detector 171. At this time, when it is estimated, based on the vibration waveforms of the pressure chambers 20, that the volume of air bubbles in the pressure chambers 20 and the nozzles 19 is large or an increase in viscosity of liquid is in progress, the droplet discharging apparatus 11 determines that the state of the insides of the pressure chambers 20 is not improved and performs the second discharge operation.

Since the second discharge operation is an operation of causing the liquid in the pressure chambers 20 to be discharged to the outside from the nozzles 19, the second discharge operation is an operation that has a higher maintenance effect with respect to the droplet discharger 12 than the first discharge operation of discharging liquid in the pressure chambers 20 to the return flow path 28 via the discharge flow path 80. In this manner, by performing the second discharge operation when the state of the inside of the pressure chamber 20 is not improved with the first discharge operation, it is possible to appropriately perform maintenance of the droplet discharger 12. The droplet discharging apparatus 11 may perform the second discharge operation when the first discharge operation is not performed since the volume of air bubbles present in the pressure chamber 20 and the nozzle 19 is smaller than the set value but the state of the inside of the pressure chamber 20 is not improved even after a time estimated to be taken for the air bubbles to be eliminated elapses.

When the number of pressure chambers 20 estimated as the pressure chamber 20 of which the inside is in an abnormal state due to air bubbles present in the pressure chamber 20 and the nozzle 19 based on the result of the detection performed by the detector 171 is equal to or larger than a set number, the droplet discharging apparatus 11 may perform, as the maintenance operation for the droplet discharger 12, the third discharge operation of causing liquid in the common liquid chamber 17 to be discharged toward the return flow path 28 via the discharge flow path 80 coupled to the common liquid chamber 17 before the first discharge operation is performed. The third discharge operation is operation of causing liquid in the common liquid chamber 17 to be discharged toward the return flow path 28 via the second discharge flow path 82. The set number is stored in the memory 163 of the controller 160.

When the number of pressure chambers 20 estimated as the pressure chamber 20 of which the inside is in an abnormal state due to air bubbles present in the pressure chamber 20 and the nozzle 19 is equal to or larger than the set number, it is considered that air bubbles are present in the common liquid chamber 17 communicating with the plurality of pressure chambers 20. In this case, there is a possibility that consecutive nozzles in the nozzle surface 18 are in an abnormal state and thus it is difficult to perform the complementary recording operation. Therefore, when the number of pressure chambers 20 estimated as the pressure chamber 20 of which the inside is in an abnormal state due to air bubbles present in the pressure chamber 20 and the nozzle 19 is equal to or larger than the set number, the third discharge operation is performed as the maintenance operation for the droplet discharger 12. Accordingly, it is possible to discharge liquid in the common liquid chamber 17 in which air bubbles are expected to be present. In the present embodiment, air bubbles in liquid discharged from the droplet discharger 12 is removed by the degasification mechanism 46 when being circulated in the circulation path 30.

The droplet discharging apparatus 11 may perform, as the maintenance operation for the droplet discharger 12, the fourth discharge operation of causing liquid in the pressure chambers 20 to be discharged toward the return flow path 28 via the discharge flow path 80 coupled to the pressure chambers 20 at a flow rate lower than the first discharge operation when droplets are discharged from the nozzles 19 during the recording process. The fourth discharge operation is an operation of causing liquid in the pressure chambers 20 to be discharged toward the return flow path 28 via the first discharge flow path 81 at a flow rate lower than the first discharge operation.

The time when droplets are discharged from the nozzles 19 during the recording process is, for example, a time when an image is recorded on the recording medium 113. When liquid in the pressure chambers 20 is discharged toward the return flow path 28 via the discharge flow path 80 coupled to the pressure chambers 20 in order to suppress an increase in viscosity of liquid, the pressure in the pressure chambers 20 is likely to become unstable due to the flow of liquid. If the pressure in the pressure chambers 20 becomes unstable when droplets are discharged from the nozzles 19 during the recording process, the discharge accuracy of the nozzles 19 discharging droplets is decreased. Therefore, when droplets are discharged from the nozzles 19 during the recording process, the fourth discharge operation is performed as the maintenance operation for the droplet discharger 12.

In the fourth discharge operation, the pressure in the pressure chambers 20 does not significantly fluctuate since liquid flows from the pressure chambers 20 to the return flow path 28 at a low flow rate in comparison with the first discharge operation. That is, the pressure in the pressure chambers 20 is less likely to be unstable. By performing the fourth discharge operation, it is possible to suppress an increase in viscosity of liquid while suppressing a fluctuation in pressure in the pressure chambers 20 even when droplets are discharged from the nozzles 19 during the recording process. The fourth discharge operation is particularly effective in suppressing an increase in viscosity of liquid in the nozzles 19 not used for the recording during the recording process and the pressure chambers 20 communicating with the nozzles 19. The flow rate of liquid is the volume of liquid flowing per unit time.

In FIG. 5, the position of a normal meniscus that is formed when the liquid in the pressure chambers 20 does not flow is represented with a meniscus E, the position of a meniscus that is formed when the fourth discharge operation is performed is represented with a meniscus F, and the position of a meniscus that is formed when the first discharge operation is performed is represented with a meniscus G. When the first discharge operation or the fourth discharge operation is performed, a meniscus on the gas-liquid interface in the nozzle 19 is moved toward the pressure chamber 20 side. Therefore, the meniscus E is positioned closer to the nozzle surface 18 than the meniscus F and the meniscus G in the nozzle 19.

In the case of the fourth discharge operation, the amount of movement of a meniscus in the nozzle 19 is small since liquid flows at a lower flow rate than the first discharge operation. Therefore, the meniscus F is positioned between the meniscus E and the meniscus G in the nozzle 19.

The droplet discharging apparatus 11 may perform, as the maintenance operation for the droplet discharger 12, the fifth discharge operation of causing liquid in the pressure chambers 20 to be discharged toward the return flow path 28 via the discharge flow path 80 coupled to the pressure chambers 20 at a flow rate higher than the first discharge operation in a state where the nozzle surface 18 is capped by the cap 151 when the recording process is not performed. The fifth discharge operation is an operation of causing liquid in the pressure chambers 20 to be discharged toward the return flow path 28 via the first discharge flow path 81 at a flow rate higher than the first discharge operation in a state where the nozzle surface 18 is capped by the cap 151 when the recording process is not performed.

When a flow rate at which liquid flows from the pressure chambers 20 toward the return flow path 28 is made higher with the liquid sucked from the discharge flow path 80 side, there is a possibility that the outside air is drawn into the pressure chambers 20 through the nozzles 19. However, if the nozzle surface 18 is capped by the cap 151 when liquid in the pressure chambers 20 is discharged toward the return flow path 28 via the discharge flow path 80 coupled to the pressure chambers 20, a possibility that the outside air enters the pressure chambers 20 through the nozzles 19 is decreased.

When a flow rate at which liquid flows from the pressure chambers 20 toward the return flow path 28 is made higher with the liquid pressurized from the liquid supply flow path 27 side, there is a possibility that the liquid flows out through the nozzles 19. However, if the nozzle surface 18 is capped by the cap 151 when liquid in the pressure chambers 20 is discharged toward the return flow path 28 via the discharge flow path 80 coupled to the pressure chambers 20, a possibility that the liquid flows out through the nozzles 19 is decreased.

Due to the above-described reasons, in a state where the nozzle surface 18 is capped by the cap 151, it is possible to make a flow rate at which liquid is discharged from the insides of the pressure chambers 20 toward the return flow path 28 via the discharge flow path 80 coupled to the pressure chambers 20 higher. The higher the flow rate at which liquid is discharged from the insides of the pressure chambers 20 to the return flow path 28, the greater the maintenance effect with respect to the droplet discharger 12. By performing the fifth discharge operation with the nozzle surface capped, it is possible to effectively perform maintenance of the droplet discharger 12. When the cap 151 is provided with the atmosphere opening valve, the fifth discharge operation is performed with the atmosphere opening valve closed.

Next, as a maintenance method for the droplet discharging apparatus 11, an example of a maintenance process for performing the maintenance operation of the droplet discharger 12 will be described. The maintenance process is repeatedly performed while the droplet discharger 12 is performing the recording process.

Figure 11:
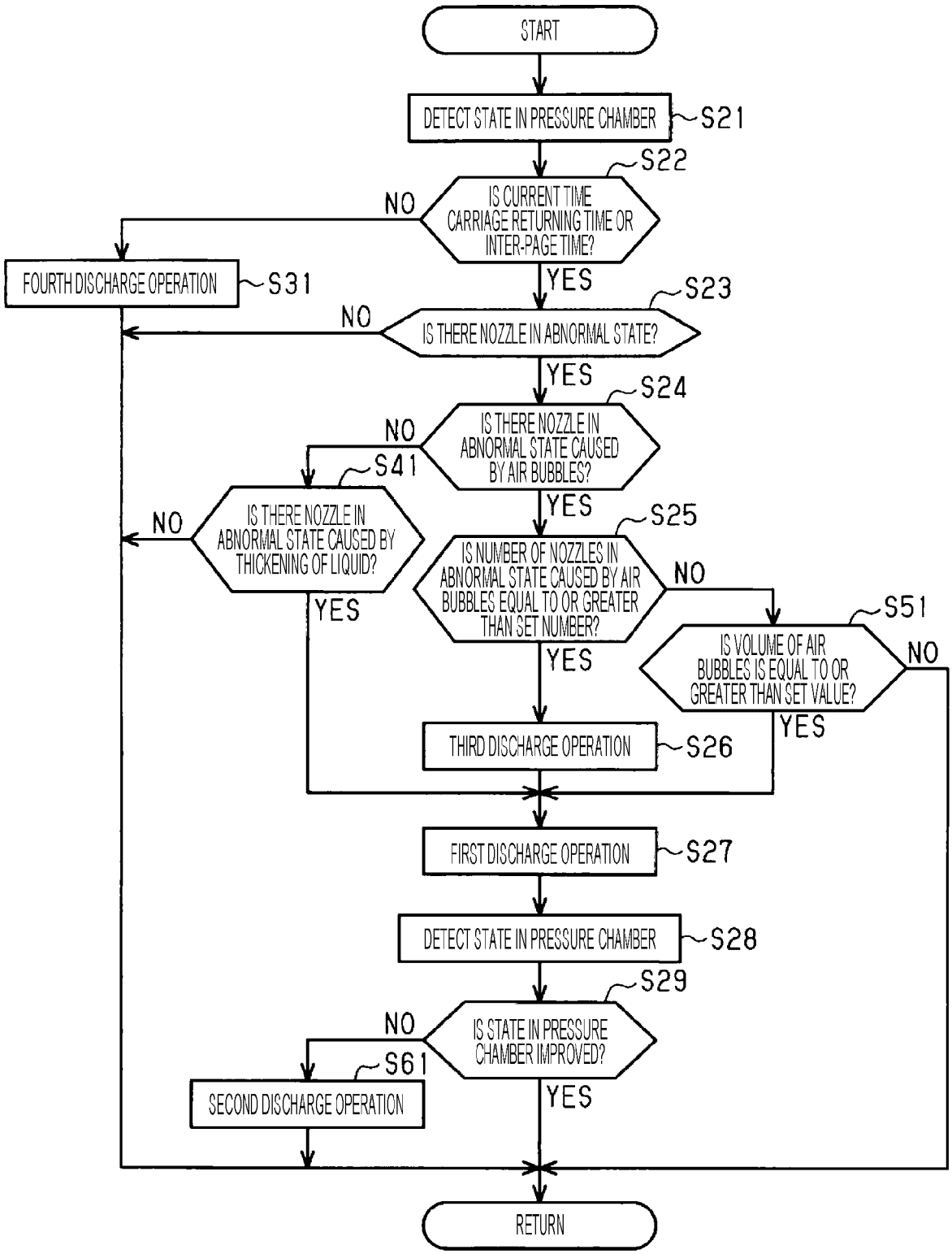
FIG. 11 is a flowchart illustrating an example of a maintenance process.

As illustrated in FIG. 11, the controller 160 that performs the maintenance process detects the state of the insides of the pressure chambers 20 with the detector 171 in Step S21. The controller 160 detects the state of the insides of all of the pressure chambers 20 by performing the nozzle inspection with respect to all of the nozzles 19 in Step S21. The vibration waveforms of the pressure chambers 20 detected by the detector 171 in Step S21 may be vibration waveforms attributable to the actuators 24 driven to discharge droplets or vibration waveforms attributable to the actuators 24 driven to such an extent that droplets are not discharged.

In Step S22, the controller 160 determines whether a current time is the returning time of the carriage 124 or the inter-page time of the recording medium 113 or not. In other words, in Step S22, the controller 160 determines whether a current time is a time when droplets are discharged from the nozzles 19 or not. The controller 160 transitions into a process in Step S31 when it is determined that the current time is not the returning time of the carriage 124 or the inter-page time of the recording medium 113 in Step S22. The controller 160 transitions into a process in Step S23 when it is determined that the current time is the returning time of the carriage 124 or the inter-page time of the recording medium 113 in Step S22.

In Step S23, the controller 160 determines whether an abnormal nozzle is present or not. In Step S23, the controller 160 determines whether an abnormal nozzle is present or not based on the result of the nozzle inspection performed in Step S21. In other words, in Step S23, the controller 160 estimates whether the state of the insides of the pressure chambers 20 is abnormal or not. The controller 160 transitions into a process in Step S24 when it is determined that an abnormal nozzle is present in Step S23. The controller 160 terminates the maintenance process when it is determined that an abnormal nozzle is not present in Step S23. When the maintenance process is terminated while the droplet discharger 12 is performing the recording process, the controller 160 restarts the maintenance process.

In Step S24, the controller 160 determines whether an abnormal nozzle caused by air bubbles is present or not. In Step S24, the controller 160 estimates whether a cause of the abnormal nozzle is air bubbles or not based on the vibration waveforms of the pressure chambers 20 detected in Step S21. In other words, in Step S24, the controller 160 estimates whether a cause of the abnormality in the pressure chamber 20 is air bubbles or not. The controller 160 transitions into a process in Step S25 when it is determined that a cause of the abnormal nozzle is air bubbles in Step S24. The controller 160 transitions into a process in Step S41 when it is determined that a cause of the abnormal nozzle is not air bubbles in Step S24.

In Step S25, the controller 160 determines whether the number of abnormal nozzles caused by air bubbles is equal to or greater than the set number or not. In Step S25, the controller 160 estimates whether the number of abnormal nozzles caused by air bubbles is equal to or greater than the set number or not based on the vibration waveforms of the pressure chambers 20 detected in Step S21. In other words, in Step S25, the controller 160 estimates whether the number of pressure chambers 20 in an abnormal state caused by air bubbles is equal to or greater than the set number or not. The controller 160 transitions into a process in Step S26 when it is determined that the number of abnormal nozzles caused by air bubbles is equal to or greater than the set number in Step S25. The controller 160 transitions into a process in Step S51 when it is determined that the number of abnormal nozzles caused by air bubbles is smaller than the set number in Step S25.

In Step S26, the controller 160 performs the third discharge operation. In Step S26, since the number of abnormal nozzles caused by air bubbles is equal to or greater than the set number, it is considered that air bubbles are present in the common liquid chamber 17. Therefore, the third discharge operation is performed such that the air bubbles are discharged from the common liquid chamber 17. The controller 160 performs the third discharge operation for a predetermined time in Step S26.

In Step S27, the controller 160 performs the first discharge operation. It is considered that air bubbles are present in the pressure chambers 20 when a process in Step S27 is reached after the process in Step S26 is performed. Therefore, the controller 160 performs the first discharge operation in Step S27 after the process in Step S26 is finished such that the air bubbles are discharged from the pressure chambers 20. In Step S27, the controller 160 performs the first discharge operation for a predetermined time.

In Step S28, the controller 160 detects the state of the insides of the pressure chambers 20. In Step S28, the controller 160 performs the same process as in Step S21.

In Step S29, the controller 160 determines whether the state of the insides of the pressure chambers 20 is improved or not due to the maintenance operation. That is, in Step S29, the controller 160 estimates whether the state of the insides of the pressure chambers 20 is improved or not by comparing the vibration waveforms of the pressure chambers 20 detected at intervals in Step S21 and Step S28. The controller 160 terminates the maintenance process when it is determined that the state of the insides of the pressure chambers 20 is improved in Step S29. The controller 160 transitions into a process in Step S61 when it is determined that the state of the insides of the pressure chambers 20 is not improved in Step S29.

In Step S61, the controller 160 performs the second discharge operation. In Step S61, since the state of the insides of the pressure chambers 20 is not improved with the first discharge operation performed in Step S27, a discharge operation having a higher maintenance effect than the first discharge operation is performed. Therefore, in Step S61, the controller 160 performs the second discharge operation having a high maintenance effect such that the state of the insides of the pressure chambers 20 is improved. The controller 160 terminates the maintenance process after the second discharge operation is performed.

When it is determined in Step S22 that the current time is not the returning time of the carriage 124 or the inter-page time of the recording medium 113, the controller 160 performs the fourth discharge operation in Step S31. In Step S31, since an image is being recorded on the recording medium 113, a great fluctuation in pressure in the pressure chambers 20 is not preferable. Therefore, in Step S31, the controller 160 performs the fourth discharge operation in which liquid flows at a flow rate lower than the first discharge operation. In Step S31, the controller 160 terminates the maintenance process after performing the fourth discharge operation for a predetermined time.

When it is determined in Step S24 that a cause of the abnormal nozzle is not air bubbles, the controller 160 determines whether an abnormal nozzle caused by an increase in viscosity of liquid is present or not in Step S41. In Step S41, the controller 160 estimates whether a cause of the abnormal nozzle is an increase in viscosity of liquid or not based on the vibration waveforms of the pressure chambers 20 detected in Step S21. In other words, in Step S41, the controller 160 estimates whether a cause of the abnormality in the pressure chamber 20 is an increase in viscosity of liquid or not. The controller 160 transitions into a process in Step S27 when it is determined that a cause of the abnormal nozzle is an increase in viscosity of liquid in Step S41. The controller 160 terminates the maintenance process when it is determined that a cause of the abnormal nozzle is not an increase in viscosity of liquid in Step S41.

It is considered that there is an increase in viscosity liquid in the pressure chambers 20 when the process in Step S27 is reached after the process in Step S41 is performed. Therefore, in Step S27, the controller 160 performs the first discharge operation after the process in Step S41 is finished such that the liquid increased in viscosity is discharged from the pressure chambers 20.

When it is determined in Step S25 that the number of abnormal nozzles caused by air bubbles is smaller than the set number, the controller 160 determines whether the volume of air bubbles present in the pressure chambers 20 and the nozzles 19 communicating with the pressure chambers 20 is equal to or greater than the set value or not in Step S51. The controller 160 transitions into a process in Step S27 when it is determined that the volume of air bubbles present in the pressure chambers 20 and the nozzles 19 communicating with the pressure chambers 20 is equal to or greater than the set value in Step S51.

It is considered that air bubbles are present in the pressure chambers 20 when the process in Step S27 is reached after the process in Step S51 is performed. Therefore, in Step S27, the controller 160 performs the first discharge operation after the process in Step S51 is finished such that the air bubbles are discharged from the pressure chambers 20. In Step S27, the controller 160 performs the first discharge operation for a predetermined time.

When it is determined in Step S51 that the volume of air bubbles present in the pressure chambers 20 and the nozzles 19 communicating with the pressure chambers 20 is smaller than the set value, the controller 160 terminates the maintenance process. When it is determined in Step S51 that the volume of air bubbles present in the pressure chambers 20 and the nozzles 19 communicating with the pressure chambers 20 is smaller than the set value, it is estimated that the air bubbles will be eliminated with time. Therefore, in this case, the controller 160 does not perform the first discharge operation. When the recording process is continued after the process in Step S51 is finished, the controller 160 may perform the above-described complementary recording operation. The controller 160 may wait for a time estimated to be taken for the air bubbles to be eliminated after the process in Step S51 is finished.

Next, a cleaning operation of the droplet discharger 12 will be described.

The droplet discharging apparatus 11 is configured to perform the cleaning operation of causing liquid to be forcibly discharged from the nozzles 19 of the droplet discharger 12. The cleaning operation is an operation which has a higher maintenance effect with respect to the droplet discharger 12 than the discharge operation.

In the present embodiment, the controller 160 performs the cleaning operation of causing liquid to be discharged from the nozzles 19 of the droplet discharger 12 by causing the pressurizing mechanism 31 to pressurize the inside of the droplet discharger 12 such that pressure in the droplet discharger 12 is made higher than the pressure of the outside of the droplet discharger 12. That is, the controller 160 performs pressurization cleaning as the cleaning operation by causing the pressurizing mechanism 31 to pressurize the inside of the droplet discharger 12. The droplet discharging apparatus 11 may be configured to perform suction cleaning as the cleaning operation, the suction cleaning being an operation of forcibly discharging liquid from the nozzles 19 by sucking air in the cap 151 in a state where the nozzle surface 18 is capped.

That is, when performing the cleaning operation, the controller 160 causes the pressing mechanism 48 to press the diaphragm 56 such that the on-off valve 59 is opened. The controller 160 drives the pressurizing mechanism 31 with the on-off valve 59 opened such that liquid is supplied to the pressure adjustment mechanism 35 and the droplet discharger 12. In this manner, the controller 160 causes the pressurizing mechanism 31 to pressurize the inside of the droplet discharger 12. In this manner, the cleaning operation is performed.

The controller 160 drives the pressurizing pump 74 when opening the on-off valve 59 such that pressurized liquid is supplied to the expansion and contraction portion 67. The expansion and contraction portion 67 expands due to the supplied liquid and thus the diaphragm 56 is displaced in a direction in which the volume of the liquid outflow portion 51 is reduced. Therefore, the on-off valve 59 enters the opened state. The controller 160 controls the pressure adjustment unit 69 when closing the on-off valve 59 such that fluid supplied to the expansion and contraction portion 67 is discharged to the outside. As described above, the controller 160 opens or close the on-off valve 59 based on the driving of the pressing mechanism 48.

The pressure in the droplet discharger 12 after the cleaning operation is likely to be higher than the pressure in the droplet discharger 12 at the time of the recording process. Specifically, the pressure in the droplet discharger 12 becomes a negative pressure at the time of the recording process but the pressure in the droplet discharger 12 is likely to become a positive pressure higher than the atmospheric pressure after the cleaning operation. Therefore, when the recording process is performed after the cleaning operation is performed, droplets may be unstably discharged from the nozzles 19. For example, the size of a droplet discharged from the nozzle 19 of the droplet discharger 12 may not be a desired size or droplets may not be discharged at a time when the droplets need to be discharged.

In the present embodiment, when the cleaning operation is performed, the controller 160 performs a pressure reducing operation after performing a cleaning stopping operation of stopping the cleaning operation. The pressure reducing operation is an operation of reducing the pressure in the droplet discharger 12 and a portion of the liquid supply flow path 27 that is positioned downstream of the pressure adjustment mechanism 35.

The controller 160 performs a finishing wiping operation of wiping the nozzle surface 18 of the droplet discharger 12 in a state where the pressure in the droplet discharger 12 is reduced due to the pressure reducing operation. In this case, the pressure in the droplet discharger 12 becomes an appropriate pressure before the recording process is performed and meniscuses suitable for droplet discharge are formed in the nozzles 19 of the droplet discharger 12. In the pressure reducing operation, the pressure in the droplet discharger 12 is reduced such that the meniscuses formed in the nozzles 19 are positioned in the nozzles 19.

In addition, when the cleaning operation is performed for a long period of time, the amount of liquid consumed by being discharged from the nozzles 19 of the droplet discharger 12 may become excessively large with respect to the amount of liquid that the pressurizing mechanism 31 supplies to the droplet discharger 12. In this case, the flow speed of liquid flowing in the liquid supply flow path 27 gradually decreases. When the flow speed of liquid flowing in the liquid supply flow path 27 is decreased, it may not be possible to effectively discharge foreign substances such as air bubbles present in the droplet discharger 12 and the liquid supply flow path 27.

In the present embodiment, the controller 160 repeatedly performs the cleaning operation and the cleaning stopping operation of stopping the cleaning operation to be performed at short intervals. Accordingly, a gradual decrease in flow speed of liquid flowing in the liquid supply flow path 27 is suppressed. An effect of discharging foreign substances such as air bubbles present in the liquid supply flow path 27 becoming weak is suppressed.

Next, an example of a cleaning process performed by the controller 160 in the present embodiment will be described with reference to a flowchart in FIG. 12. The cleaning process is a process including the cleaning operation. The cleaning process may be performed for each predetermined control cycle, may be performed only when it is expected that there is droplet discharge failure in the nozzles 19. The cleaning process may be performed manually by a user or an operator of the droplet discharging apparatus 11.

Figure 12:
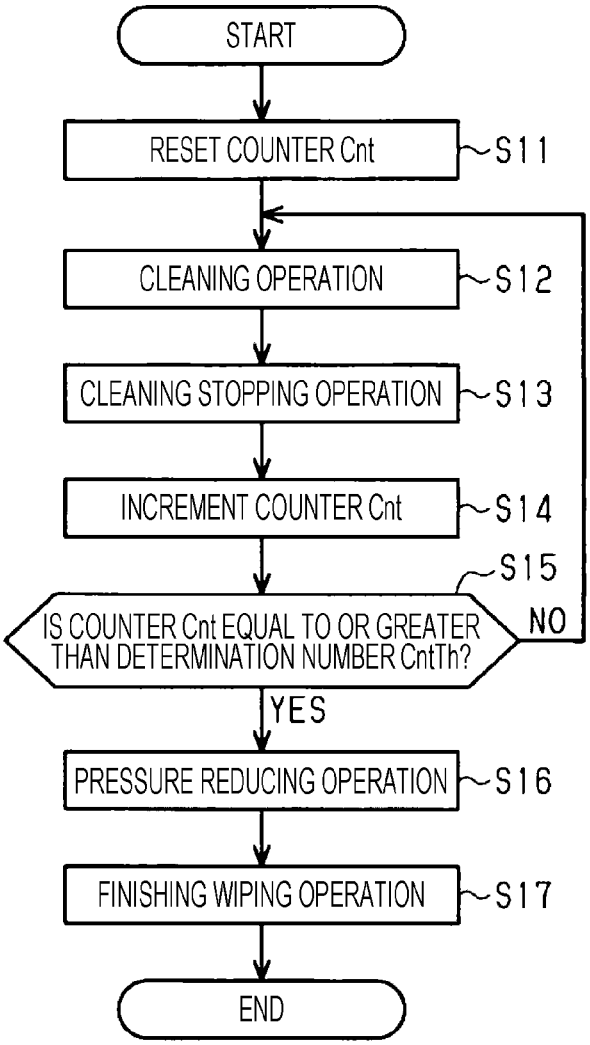
FIG. 12 is a flowchart illustrating an example of a cleaning process.

As illustrated in FIG. 12, the controller 160 resets a counter Cnt, which is a variable for counting, in Step S11. That is, the controller 160 resets the counter Cnt to "0" in Step S11.

In Step S12, the controller 160 performs the cleaning operation. In Step S12, the controller 160 controls the driving of the pressing mechanism 48 such that the diaphragm 56 is displaced in a direction in which the volume of the liquid outflow portion 51 is reduced. In this manner, the controller 160 causes the on-off valve 59 to enter the opened state. When the on-off valve 59 enters the opened state, pressurized liquid flows into the liquid outflow portion 51, the liquid supply flow path 27, the common liquid chamber 17, the pressure chambers 20, and the nozzles 19. As a result, the liquid is discharged from the nozzles 19. In Step S12, the controller 160 performs the cleaning operation for the predetermined time.

In Step S13, the controller 160 performs the cleaning stopping operation to stop the cleaning operation. In Step S13, the controller 160 controls the driving of the pressing mechanism 48 such that the diaphragm 56 is displaced in a direction in which the volume of the liquid outflow portion 51 increases. In this manner, the controller 160 causes the on-off valve 59 to enter the closed state. When the on-off valve 59 enters the closed state, pressurized liquid is not supplied downstream of the pressure adjustment mechanism 35. As a result, the cleaning operation is stopped. A period of time between the start of the cleaning operation and the start of the cleaning stopping operation may be, for example, a period of time of about 0.1 seconds to 1.0 second.

In Step S14, the controller 160 increments the counter Cnt by "1".

In Step S15, the controller 160 determines whether the counter Cnt is equal to or greater than a determination number CntTh. The determination number CntTh is a determination value for determining the number of times the cleaning operation and the cleaning stopping operation are repeatedly performed. Therefore, the determination number CntTh may be determined based on the specifications of the droplet discharging apparatus 11 or set by the user. Note that, when the nozzle inspection is performed for all of the nozzles 19 of the droplet discharger 12, the determination number CntTh may be determined corresponding to the number of abnormal nozzles in each of which a droplet discharge failure occurs.

The controller 160 transitions into a process in Step S12 when it is determined that the counter Cnt is smaller than the determination number CntTh in Step S15. The controller 160 transitions into a process in Step S16 when it is determined that the counter Cnt is equal to or greater than the determination number CntTh in Step S15.

In Step S16, the controller 160 performs the pressure reducing operation. In the present embodiment, the pressure reducing operation is a wiping operation of wiping the nozzle surface 18 by using the wiping mechanism 140. Hereinafter, the wiping operation is referred to as a preceding wiping operation. As a result of the preceding wiping operation, the wiping portion 149 comes into contact with gas-liquid interfaces positioned outside the nozzles 19 or in the vicinity of the openings of the nozzles 19, so that pressurized liquid leaks out from the nozzles 19. Accordingly, the pressure in the droplet discharger 12 is reduced.

Immediately after the last cleaning stopping operation is performed in the cleaning process, the liquid may continue to leak out from the nozzles 19 of the droplet discharger 12 due to the cleaning operation performed immediately before the cleaning stopping operation. Therefore, it is preferable that the preceding wiping operation be performed after the liquid stops to leak out due to the cleaning operation. In the present embodiment, since the pressure reducing operation is performed when the counter Cnt is equal to or greater than the determination number CntTh, the pressure reducing operation is an operation that is performed after the last discharge stopping operation is performed.

In Step S17, the controller 160 performs a finishing wiping operation. The finishing wiping operation is a wiping operation of wiping the nozzle surface 18 by using the wiping mechanism 140. Therefore, in the present embodiment, the controller 160 performs the wiping operations in both of Step S16 and Step S17. As a result of the finishing wiping operation, liquid or foreign substances adhering to the nozzle surface 18 is removed and meniscuses suitable for droplet discharge are formed in the nozzles 19. The controller 160 temporarily terminates the cleaning process after the process in Step S17 is finished.

The cleaning process in the present embodiment is a process including the cleaning operation, the cleaning stopping operation, the preceding wiping operation which is the pressure reducing operation, and the finishing wiping operation. The cleaning process in the present embodiment is an operation for recovering the droplet discharge performance of the droplet discharger 12. The cleaning process may be performed, for example, when it is expected that the droplet discharge performance of the droplet discharger 12 is not recovered in the maintenance process in which the discharge operation is performed. The cleaning process may be performed, for example, when the state of the insides of the pressure chambers 20 is not improved continuously.

Next, the effect when the droplet discharging apparatus 11 performs the cleaning process will be described.

When the droplet discharging apparatus 11 performs the recording process, a portion of the plurality of nozzles 19 provided in the droplet discharger 12 may become abnormal nozzles in which a droplet discharge failure occurs. In this case, the cleaning process may be performed to recover the defective nozzles from the droplet discharge failure.

Figure 13:
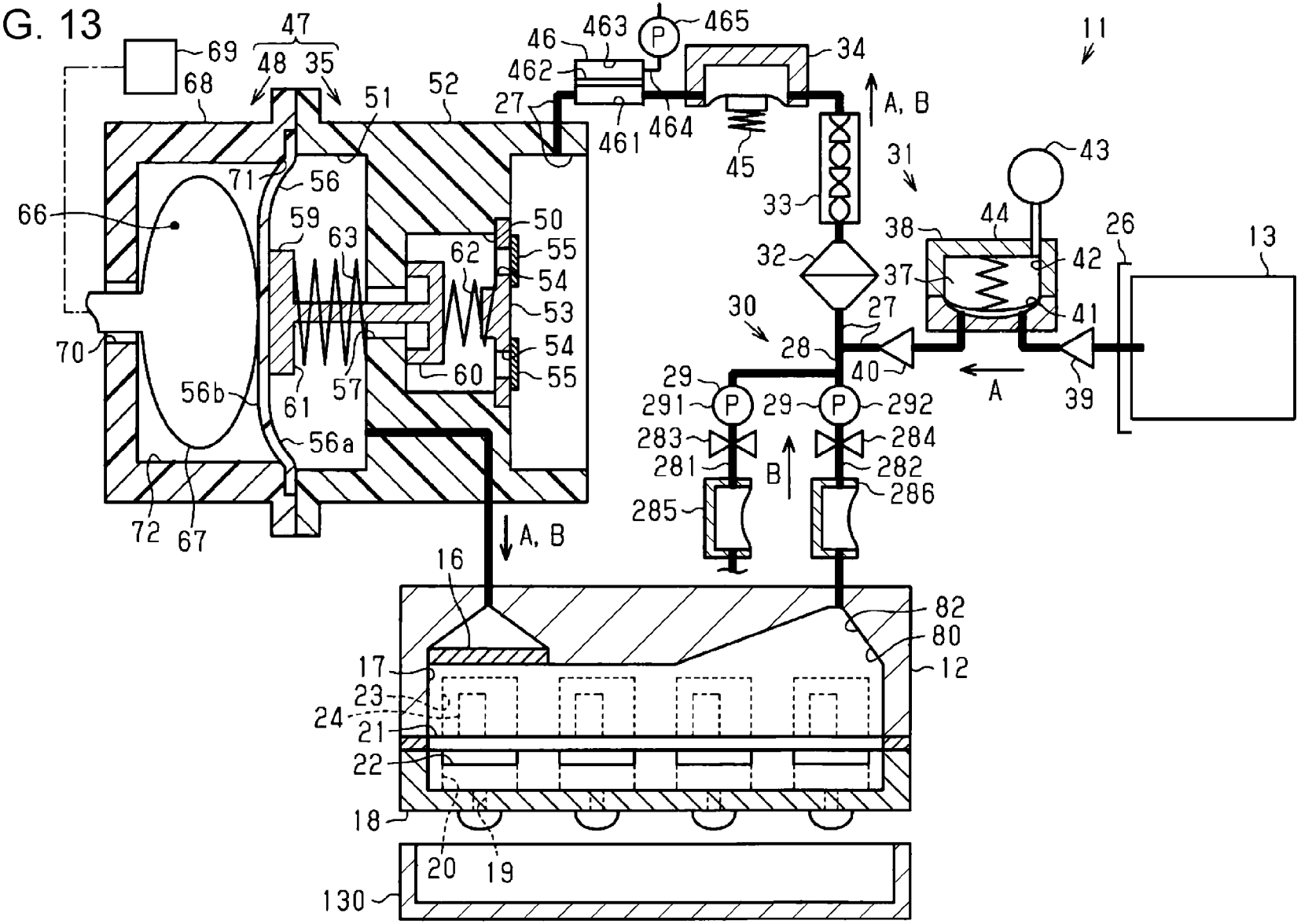
FIG. 13 is a sectional view schematically illustrating the pressure adjustment mechanism and the droplet discharger with the on-off valve opened.

As illustrated in FIG. 13, when the cleaning process is performed, the pressurizing pump 74 is driven such that pressurized fluid is supplied to the expansion and contraction portion 67. Then, the expansion and contraction portion 67 supplied with the fluid expands and presses a region of the diaphragm 56 that comes into contact with the pressure receiving portion 61 such that the on-off valve 59 enters the opened state.

The pressing mechanism 48 moves the pressure receiving portion 61 against pressing forces of the upstream pressing member 62 and the downstream pressing member 63 such that the on-off valve 59 enters the opened state. In this case, since the pressure adjustment unit 69 is coupled to the expansion and contraction portions 67 of the plurality of pressure adjustment devices 47, all of the on-off valves 59 in the pressure adjustment devices 47 enter the opened state.

When the on-off valve 59 is caused to enter the opened state, the diaphragm 56 is displaced in a direction in which the volume of the liquid outflow portion 51 is reduced. Therefore, liquid accommodated in the liquid outflow portion 51 is pressed out toward the droplet discharger 12 side. That is, a pressure with which the diaphragm 56 presses the liquid outflow portion 51 is transmitted to the droplet discharger 12 and thus the meniscuses collapse and liquid flows out from the nozzles 19. The pressing mechanism 48 presses the diaphragm 56 such that the pressure in the liquid outflow portion 51 becomes higher than a pressure at which at least one meniscus collapses. The pressing mechanism 48 presses the diaphragm 56 such that, for example, a liquid side pressure becomes 3 kPa higher than an air side pressure for each of the gas-liquid interfaces in the nozzles 19.

The pressing mechanism 48 presses the diaphragm 56 such that the on-off valve 59 enters the opened state regardless of the pressure in the liquid inflow portion 50. In this case, the pressing mechanism 48 presses the diaphragm 56 with a pressing force that is greater than a pressing force that is generated when a pressure, which is obtained by adding the above-described predetermined value to a pressure at which the pressurizing mechanism 31 pressurizes liquid, is applied to the diaphragm 56.

The pressure reduction unit 43 is periodically driven in a state where the on-off valve 59 is in the opened state and thus the liquid pressurized by the pressurizing mechanism 31 is supplied to the droplet discharger 12. That is, when the pressure reduction unit 43 is driven and the pressure in the negative pressure chamber 42 is reduced, the flexible member 37 moves in a direction in which the volume of the pump chamber 41 increases.

When the flexible member 37 moves in a direction in which the volume of the pump chamber 41 increases, liquid from the liquid supply source 13 flows into the pump chamber 41. When the pressure reduction performed by the pressure reduction unit 43 is stopped, the flexible member 37 is pressed by the pressing force of the pressing member 44 in a direction in which the volume of the pump chamber 41 is reduced. That is, liquid in the pump chamber 41 is pressurized by the pressing force of the pressing member 44 via the flexible member 37. The liquid in the pump chamber 41 is supplied to the downstream of the liquid supply flow path 27 while passing through the one-way valve 40 positioned downstream of the pump chamber 41.

While the pressing mechanism 48 presses the diaphragm 56, the opened state of the on-off valve 59 is maintained. Therefore, if the pressurizing mechanism 31 pressurizes liquid a state where the opened state of the on-off valve 59 is maintained, the pressurizing force is transmitted to the droplet discharger 12 via the liquid inflow portion 50, the communication path 57, and the liquid outflow portion 51. Accordingly, the pressurization cleaning, which is the cleaning operation in which liquid is discharged from the nozzles 19 is performed. As illustrated in FIG. 13, when the cleaning operation is performed, the carriage 124 may be moved such that the droplet discharger 12 faces the liquid receiver 131 and the liquid receiver 131 receives liquid discharged from the nozzles 19.

After the cleaning operation is performed, the cleaning stopping operation of stopping the cleaning operation is performed. In the cleaning stopping operation, the pressing mechanism 48 is caused to stop to press the diaphragm 56 such that the on-off valve 59 enters the closed state. Accordingly, the upstream and the downstream of the pressure adjustment mechanism 35 are blocked and pressurized liquid is not supplied from the liquid supply source 13 to the droplet discharger 12.

In the present embodiment, the cleaning operation and the cleaning stopping operation are repeatedly performed at short intervals. Accordingly, a decrease in flow speed of liquid flowing in the liquid supply flow path 27 and the droplet discharger 12 during the cleaning operation is suppressed and it becomes easy to remove foreign substances such as air bubbles from the liquid supply flow path 27 and the droplet discharger 12.

The pressure in the droplet discharger 12 disposed downstream of the pressure adjustment mechanism 35 becomes high immediately after the cleaning stopping operation is performed. That is, immediately after the cleaning stopping operation is performed, the state of the inside of the droplet discharger 12 becomes not suitable for the recording process. Therefore, after the cleaning stopping operation is performed, the preceding wiping operation is performed as the pressure reducing operation to reduce the pressure in the droplet discharger 12.

Immediately after the cleaning stopping operation is performed, liquid continues to drop from the nozzles 19. That is, immediately after the cleaning stopping operation is performed, a state in which liquid is discharged from the nozzles 19 continues. The liquid continues to be discharged from the nozzles 19 until the pressure in droplet discharger 12 is reduced and meniscuses are formed in the nozzles 19. At this time, each of the meniscuses that are formed in the nozzles 19 or in the vicinity of the openings of the nozzles 19 is a meniscus that is curved toward the outside of the nozzle 19 from the nozzle opening or the vicinity of the opening of the nozzle 19 instead of a meniscus that is formed in the nozzle 19 in a case where the recording process is performed and that is curved toward the inside of the nozzle 19.

Figure 14:
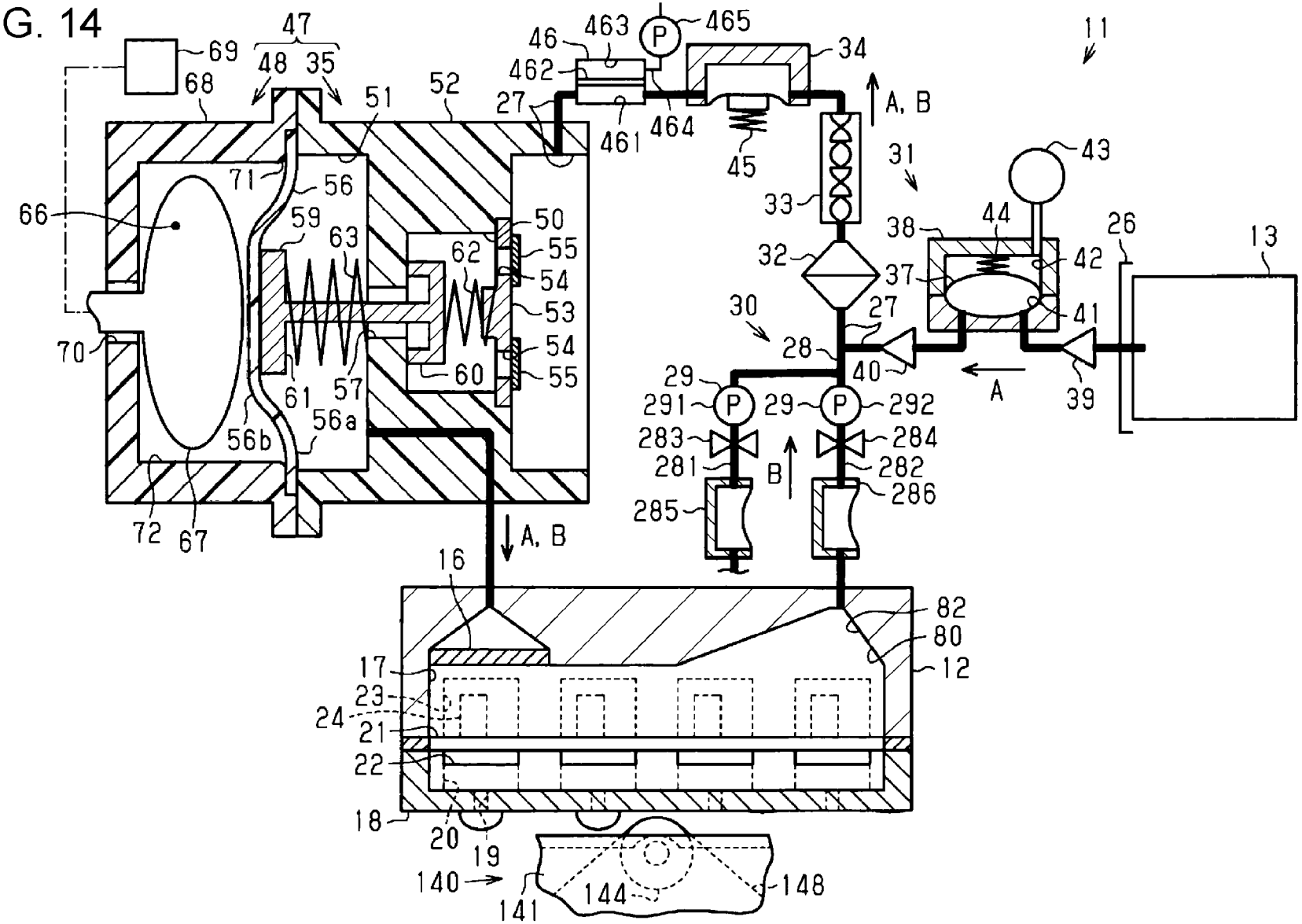
FIG. 14 is a sectional view schematically illustrating the pressure adjustment mechanism and the droplet discharger in the middle of a pressure reducing operation.

As illustrated in FIG. 14, in the preceding wiping operation, the carriage 124 is moved such that the droplet discharger 12 faces the wiping mechanism 140 and the wiping mechanism 140 wipes the droplet discharger 12. Therefore, the pressure in the droplet discharger 12 becomes a positive pressure, the gas-liquid interfaces swelling toward the outside of the nozzles 19 come into contact with the wiping portion 149 of the fabric wiper 148, and liquid leaks out from the droplet discharger 12.

The purpose of the preceding wiping operation is to reduce the pressure in the droplet discharger 12 by causing liquid to leak out from the nozzles 19. Therefore, in the preceding wiping operation, the wiping operation may be performed in a state where the gas-liquid interfaces swelling from the nozzles 19 are in contact with the wiping portion 149 while the nozzle surface 18 of the droplet discharger 12 is not in contact with the wiping portion 149 as illustrated in FIG. 14. In the preceding wiping operation, the wiping operation may be performed in a state where the nozzle surface 18 of the droplet discharger 12 is in contact with the wiping portion 149.

When the cleaning process is performed, air bubbles may not be fully discharged from droplet discharger 12 and the liquid supply flow path 27 and the air bubbles may remain in the droplet discharger 12 and the liquid supply flow path 27. In the cleaning operation, since the pressure of liquid is high, the volume of air bubbles in the liquid is small. After the cleaning stopping operation, the pressure of liquid is reduced and thus the volume of air bubbles becomes large. Therefore, the volume of air bubbles is changed in the cleaning operation and the cleaning stopping operation. Due to the change in volume of air bubbles, the pressure in the droplet discharger 12 and the liquid supply flow path 27 when the meniscuses are formed in the nozzles 19 may become higher.

When the wiping operation is performed in a state where the pressure in the droplet discharger 12 and the liquid supply flow path 27 is made higher, the wiping portion 149 may break unstable convex meniscuses swelling from the nozzle openings while coming into contact with the meniscuses and thus liquid may spread over the nozzle surface 18. That is, when the wiping operation is performed, the meniscuses formed in the nozzles 19 may become unstable. Therefore, a state where the pressure in the droplet discharger 12 and a portion of the liquid supply flow path 27 that is positioned downstream of the pressure adjustment device 47 is stable is a state where the pressure in the droplet discharger 12 and the liquid supply flow path 27 becomes a negative pressure to such an extent that meniscuses are formed in the nozzles 19.

When the preceding wiping operation is finished, the pressure in the droplet discharger 12 and the portion of the liquid supply flow path 27 that is positioned downstream of the pressure adjustment device 47 becomes stable. Thereafter, the finishing wiping operation is performed.

Figure 15:
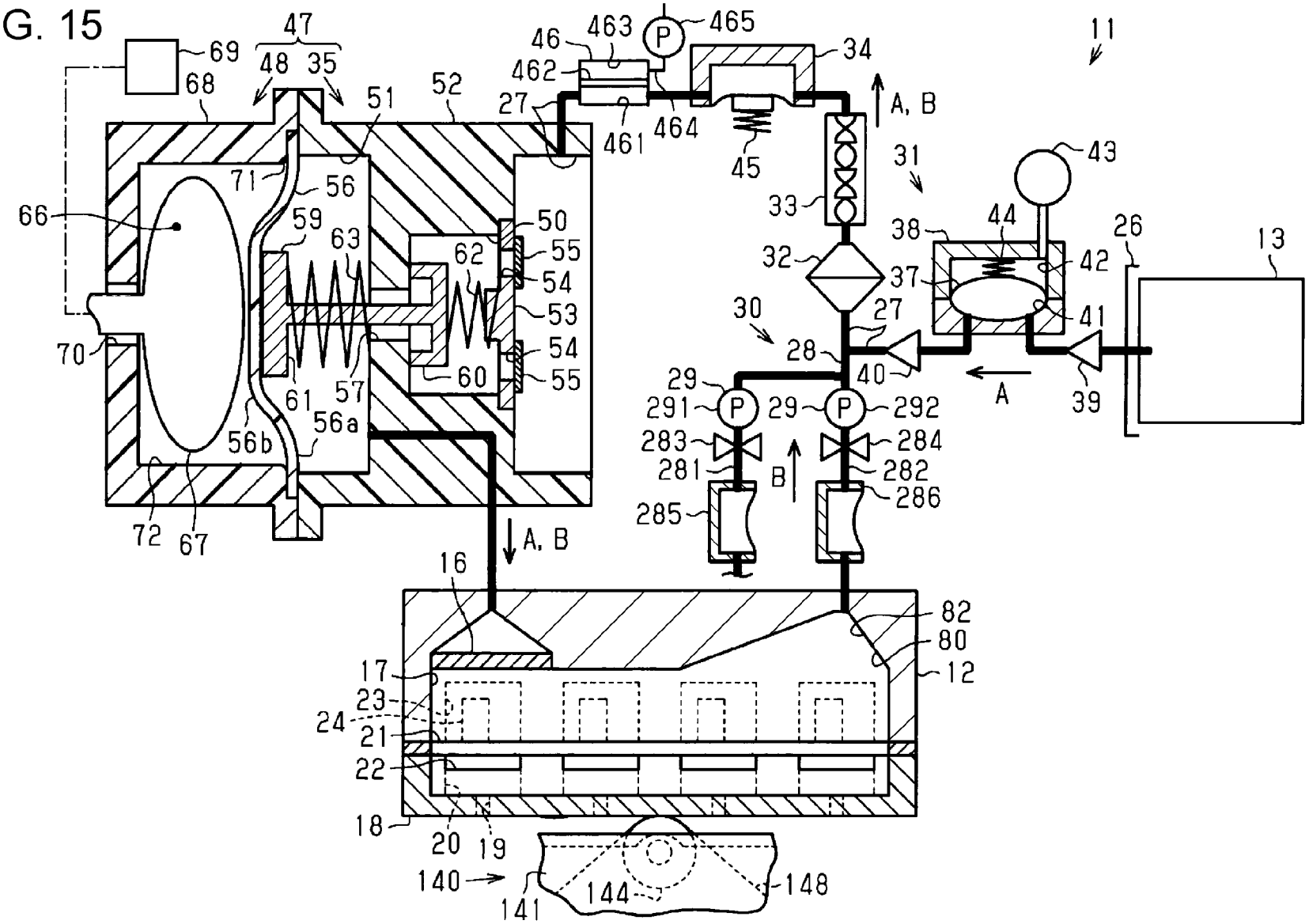
FIG. 15 is a sectional view schematically illustrating the pressure adjustment mechanism and the droplet discharger in the middle of a finishing wiping operation.

As illustrated in FIG. 15, in the finishing wiping operation, wiping is performed in a state where the wiping portion 149 of the fabric wiper 148 is in contact with the nozzle surface 18 of the droplet discharger 12. In this manner, liquid adhering to the nozzle surface 18 of the droplet discharger 12 is removed and normal meniscuses are formed in the nozzles 19 of the droplet discharger 12.

Next, a method of manufacturing the pressure adjustment device 47 according to the present embodiment will be described.

First, the main body portion 52 in the present embodiment is formed of a light absorbing resin which generates heat when absorbing laser light, or a resin colored with a dye which absorbs light. The light absorbing resin is, for example, polypropylene or polybutylene terephthalate.

The diaphragm 56 is formed by laminating different materials such as polypropylene and polyethylene terephthalate. The diaphragm 56 has transparency which allows laser light to pass therethrough and flexibility.

The retaining member 68 is formed of a light transmitting resin which transmits laser light. The light transmitting resin is, for example, polystyrene or polycarbonate. The transparency of the diaphragm 56 is greater than the transparency of the main body portion 52 and is lower than the transparency of the retaining member 68.

As illustrated in FIG. 4, first, as an interposing step, the diaphragm 56 is interposed between the retaining member 68, in which a portion of the expansion and contraction portion 67 has been inserted into the insertion hole 70, and the main body portion 52. Next, irradiation with laser light is performed via the retaining member 68 as an irradiation step. As a result, the laser light passing through the retaining member 68 is absorbed by the main body portion 52 and the main body portion 52 generates heat. The main body portion 52, the diaphragm 56, and the retaining member 68 are welded to each other due to the heat generated at this time. Therefore, the retaining member 68 also functions as a jig which presses the diaphragm 56 when the pressure adjustment device 47 is manufactured.

Next, an operation and effect of the present embodiment will be described.

(1) The droplet discharging apparatus 11 droplet discharging apparatus 11 performs, as the maintenance operation for the droplet discharger 12, the first discharge operation of causing liquid in the pressure chambers 20 to be discharged toward the return flow path 28 via the discharge flow path 80 when no droplets are discharged from the nozzles 19 during the recording process. As a result, the liquid discharged from the pressure chambers 20 to the return flow path 28 via the discharge flow path 80 coupled to the pressure chambers 20 flows in the circulation path 30. Since the liquid flows, an increase in viscosity of the liquid is suppressed. Therefore, by using the first discharge operation, it is possible to suppress an increase in viscosity of liquid without discharging droplets from the nozzles 19. Therefore, it is possible to reduce the amount of liquid consumed for maintenance.

(2) In the first discharge operation, the droplet discharging apparatus 11 causes liquid to be discharged toward the return flow path 28 with the liquid in the pressure chambers 20 sucked from the discharge flow path 80 side such that meniscuses on gas-liquid interfaces in the nozzles 19 are maintained. As a result, the meniscuses in the nozzles 19 are moved toward the pressure chambers 20 with the liquid in the pressure chambers 20 sucked from the discharge flow path 80 side. That is, liquid in the nozzles 19 flows. Therefore, an increase in viscosity of the liquid in the nozzles 19 can be suppressed.

(3) The droplet discharging apparatus 11 performs the first discharge operation when it is estimated, based on the result of the detection performed by the detector 171, that the state of the insides of the pressure chambers 20 is abnormal since the volume of air bubbles present in the pressure chambers 20 and the nozzles 19 is equal to or greater than a set value. When the volume of air bubbles present in the pressure chambers 20 and the nozzles 19 is small, the air bubbles may be eliminated by being dissolved in liquid with time. When the volume of the air bubbles is small, it is possible to remove the air bubbles from the pressure chambers 20 and the nozzles 19 without performing the first discharge operation by, for example, waiting for a predetermined time. On the contrary, when the volume of air bubbles present in the pressure chambers 20 and the nozzles 19 is large, the air bubbles may grow with time. Therefore, the droplet discharging apparatus 11 performs the first discharge operation when the air bubbles are not estimated to be eliminated with time. It is possible to decrease a frequency at which the first discharge operation is performed since it is not necessary to perform the first discharge operation when the air bubbles are estimated to be eliminated with time.

(4) The droplet discharging apparatus 11 estimates whether the state of the insides of the pressure chambers 20 is improved or not by comparing the vibration waveforms of the pressure chambers 20 that are detected by the detector 171 at intervals and when it is estimated that the state of the insides of the pressure chambers 20 is not improved, the droplet discharging apparatus 11 performs, as the maintenance operation for the droplet discharger 12, the second discharge operation of causing liquid in the pressure chambers 20 to be discharged to the outside from the nozzles 19. That is, when the state of the insides of the pressure chambers 20 is not improved even after the first discharge operation is performed and when the state of the insides of the pressure chambers 20 is not improved after the droplet discharging apparatus 11 waits for a predetermined time, the droplet discharging apparatus 11 in the present embodiment performs the second discharge operation of causing liquid in the pressure chambers 20 to be discharged to the outside from the nozzles 19. Since the second discharge operation is an operation of causing the liquid in the pressure chambers 20 to be discharged to the outside from the nozzles 19, the second discharge operation is an operation that has a higher maintenance effect with respect to the droplet discharger 12 than the first discharge operation of causing liquid in the pressure chambers 20 to be discharged to the return flow path 28 via the discharge flow path 80. In this manner, by performing the second discharge operation when the state of the inside of the pressure chamber 20 is not improved with the first discharge operation, it is possible to appropriately perform maintenance of the droplet discharger 12.

(5) When the number of pressure chambers 20 estimated as the pressure chamber 20 of which the inside is in an abnormal state due to air bubbles present in the pressure chamber 20 and the nozzle 19 based on the result of the detection performed by the detector 171 is equal to or larger than a set number, the droplet discharging apparatus 11 performs, as the maintenance operation for the droplet discharger 12, the third discharge operation of causing liquid in the common liquid chamber 17 to be discharged toward the return flow path 28 via the second discharge flow path 82 before the first discharge operation is performed. When the number of pressure chambers 20 estimated as the pressure chamber 20 of which the inside is in an abnormal state due to air bubbles present in the pressure chamber 20 and the nozzle 19 is equal to or larger than the set number, it is considered that air bubbles are present in the common liquid chamber 17 communicating with the plurality of pressure chambers 20. Therefore, when the number of pressure chambers 20 estimated as the pressure chamber 20 of which the inside is in an abnormal state due to air bubbles present in the pressure chamber 20 and the nozzle 19 is equal to or larger than the set number, the droplet discharging apparatus 11 in the present embodiment performs the third discharge operation of causing liquid in the common liquid chamber 17 to be discharged toward the return flow path 28 via the second discharge flow path 82 coupled to the common liquid chamber 17 and the return flow path 28. Accordingly, it is possible to discharge liquid in the common liquid chamber 17 in which air bubbles are expected to be present.

(6) The droplet discharging apparatus 11 performs, as the maintenance operation for the droplet discharger 12, the fourth discharge operation of causing liquid in the pressure chambers 20 to be discharged toward the return flow path 28 via the discharge flow path 80 at a flow rate lower than the first discharge operation when droplets are discharged from the nozzles 19 during the recording process. When liquid in the pressure chambers 20 is discharged toward the return flow path 28 via the discharge flow path 80 coupled to the pressure chambers 20 in order to suppress an increase in viscosity of liquid, the pressure in the pressure chambers 20 becomes unstable due to the flow of liquid. If the pressure in the pressure chambers 20 becomes unstable when droplets are discharged from the nozzles 19 during the recording process, the discharge accuracy of the nozzles 19 discharging droplets is decreased. Therefore, when droplets are discharged from the nozzles 19 during the recording process, the droplet discharging apparatus 11 performs the fourth discharge operation of causing liquid in the pressure chambers 20 to be discharged toward the return flow path 28 via the discharge flow path 80 coupled to the pressure chambers 20 at a flow rate lower than the first discharge operation. In the fourth discharge operation, the pressure in the pressure chambers 20 does not significantly fluctuate since the flow rate is low in comparison with the first discharge operation. That is, by performing the fourth discharge operation, it is possible to suppress an increase in viscosity of liquid while suppressing a fluctuation in pressure in the pressure chambers 20 even when droplets are discharged from the nozzles 19 during the recording process.

(7) The droplet discharging apparatus 11 performs, as the maintenance operation for the droplet discharger 12, the fifth discharge operation of causing liquid in the pressure chambers 20 to be discharged toward the return flow path 28 via the discharge flow path 80 at a flow rate higher than the first discharge operation in a state where the nozzle surface 18 is capped by the cap 151 when the recording process is not performed. When liquid in the pressure chambers 20 is discharged toward the return flow path 28 via the discharge flow path 80 coupled to the pressure chambers 20 in order to suppress an increase in viscosity of liquid, the pressure in the pressure chambers 20 fluctuates due to the flow of liquid. If a flow rate at which the liquid flows from the pressure chambers 20 to the return flow path 28 is high, the pressure in the pressure chambers 20 significantly fluctuates and thus there is a possibility that the outside air enters the pressure chambers 20 through the nozzles 19 or the liquid flows out through the nozzles 19. However, if the nozzle surface 18 is capped by the cap 151 when liquid in the pressure chambers 20 is discharged toward the return flow path 28 via the discharge flow path 80 coupled to the pressure chambers 20, a possibility that the outside air enters the pressure chambers 20 through the nozzles 19 or the liquid flows out from the nozzles 19 due to a fluctuation in pressure in the pressure chambers 20 is decreased. Therefore, in a state where the nozzle surface 18 is capped by the cap 151, it is possible to make a flow rate at which liquid is discharged from the insides of the pressure chambers 20 toward the return flow path 28 via the discharge flow path 80 higher. By performing the fifth discharge operation with the nozzle surface capped, it is possible to effectively perform maintenance of the droplet discharger 12.

The present embodiment can be modified as follows. The present embodiment and the following modification examples can be combined with each other unless there is a technical contradiction.

In the first discharge operation, the actuators 24 may be driven to such an extent that liquid is not discharged from the nozzles 19. In this case, it becomes easy to discharge liquid in the pressure chambers 20 with the first discharge operation. In this case, all of the actuators 24 may be driven or the actuator 24 corresponding to the nozzle 19 with air bubbles detected by the detector 171 may be driven. When the actuator 24 corresponding to the nozzle 19 with air bubbles detected by the detector 171 is driven, the actuator 24 may be driven by using the frequency of a vibration waveform detected by the detector 171.

At the time of the fourth discharge operation, the actuator 24 corresponding to the nozzle 19 not used for the recording process may be driven to such an extent that liquid is not discharged from the nozzle 19. In this case, since the liquid is displaced in the nozzle 19 not used for the recording process, the viscosity of the liquid in the nozzle 19 is less likely to be increased.

At least a portion of the first discharge flow path 81 and at least a portion of the second discharge flow path 82 may be formed of a flexible member. In this case, it is possible to even out a fluctuation in pressure in the droplet discharger 12, which occurs when liquid flows in the discharge flow path 80, without providing the first damper 285 and the second damper 286.

A pressure sensor may be provided in the first return flow path 281 while being positioned closer to the droplet discharger 12 side than the first on-off valve 283 and a pressure sensor may be provided in the second return flow path 282 while being positioned closer to the droplet discharger 12 side than the second on-off valve 284. In this case, feedback control of the circulation pumps 29 may be performed based on a pressure detected by the pressure sensors. For example, opening and closing of the first on-off valve 283 and the second on-off valve 284 may be controlled to an extent that a fluctuation in pressure in the droplet discharger 12 is allowed. In this case, it is possible to suppress a significant fluctuation in pressure in the droplet discharger 12 which occurs when liquid flows through the discharge flow path 80 with the circulation pumps 29 driven.

The third discharge operation may be performed in the purpose of discharging air bubbles in the liquid supply flow path 27. For example, the third discharge operation may be performed to discharge air bubbles accumulated in the pressure adjustment mechanism 35.

The second return flow path 282 may be coupled t a portion of the droplet discharger 12 in which air bubbles are likely to be accumulated. For example, the second return flow path 282 may be coupled to the vicinity of the filter 16.

A flow path that couples the liquid inflow portion 50 or the liquid outflow portion 51 of the pressure adjustment mechanism 35 to the liquid supply flow path 27 may be provided. In this case, it is possible to cause liquid to circulate without passing through the droplet discharger 12. In this case, the flow path that couples the liquid inflow portion 50 or the liquid outflow portion 51 of the pressure adjustment mechanism 35 to the liquid supply flow path 27 may be provided with an on-off valve.

When a plurality of the droplet dischargers 12 are provided for each of the kinds of liquid, the droplet dischargers 12 may perform different discharge operations respectively. For example, the droplet discharger 12 performing the recording process may perform the fourth discharge operation and the droplet discharger 12 not performing the recording process may perform the first discharge operation. When a monochrome image is recorded, only black ink is used and thus cyan ink, magenta ink, and yellow ink are not used. When monochrome images are recorded consecutively, there is a possibility that an increase in viscosity of liquid may be prompted in the droplet dischargers 12 corresponding to cyan ink, magenta ink, and yellow ink not used for the recording process even if the first discharge operation is performed. Therefore, when monochrome images are recorded consecutively for a time equal to or longer than a predetermined time, the third discharge operation or the second discharge operation may be performed.

In the second discharge operation, droplets may be discharged toward the recording medium 113. In this case, the droplets discharged during the second discharge operation may be droplets that are so fine that a user cannot visually recognize the droplets when the droplets adhere to the recording medium 113. Droplets may be discharged such that the droplets are not noticeable from a recorded image and droplets may be discharged to an edge portion of the recording medium 113 that does not influence an image.

The fourth discharge operation may be continuously performed while droplets are discharged from the nozzles 19 in the recording process.

The first discharge operation may be continuously performed while droplets are not discharged from the nozzles 19 in the recording process like in the returning time of the carriage 124 and the inter-page time of the recording medium 113.

The fourth discharge operation may be basically performed while the droplet discharging apparatus 11 is activated and the first discharge operation and the second discharge operation, and the third discharge operation may be performed based on the result of the nozzle inspection in the maintenance process, may also be adopted.

The droplet discharging apparatus 11 may not be provided with the detector 171. In this case, the fourth discharge operation may be performed while droplets are discharged from the nozzles 19 in the recording process and the first discharge operation may be performed while no droplets are discharged from the nozzles 19.

The pressure reducing operation performed in Step S16 is not limited to the preceding wiping operation. The pressure reducing operation may be any operation as long as it is possible to decrease the pressure in the droplet discharger 12 by discharging pressurized liquid from the inside of the droplet discharger 12.

For example, the pressure reducing operation may be an operation of displacing the vibration plate 21 by driving the actuators 24. Specifically, the pressure reducing operation may be an operation of causing the vibration plate 21 to vibrate. In this case, it is possible to decrease the pressure in the droplet discharger 12 by discharging liquid from the nozzles 19 in a state where the pressure in the droplet discharger 12 is high and the gas-liquid interfaces in the nozzles 19 are unstable.

When the actuators 24 are driven as the pressure reducing operation, a low voltage may be applied to the actuators 24 such that the vibration plate 21 is vibrated weakly. In this case, unstable meniscuses formed in the nozzles 19 collapse due to vibration of the vibration plate 21. As a result, liquid leaks out from the nozzles 19. Vibration pertaining to a case where the vibration plate 21 is vibrated weakly means vibration of the vibration plate 21 with which liquid is not discharged from the nozzles 19 even when normal meniscuses are formed in the nozzles 19.

When the actuators 24 are driven as the pressure reducing operation, a high voltage may be applied to the actuators 24 such that the vibration plate 21 is vibrated strongly. In this case, liquid is discharged from the nozzles 19 and thus it is possible to more reliably reduce the pressure in the droplet discharger 12. Note that, vibration in a case where the vibration plate 21 is vibrated strongly means the vibration of the vibration plate 21 at a time when liquid is discharged to the recording medium 113 (for example, at time of recording process).

The pressure reducing operation may be a combination of the preceding wiping operation and an operation of driving the actuators 24.

In the flowchart illustrated in FIG. 12, the controller 160 may perform the flushing as the second discharge operation after the finishing wiping operation is performed. In this case, normal meniscuses are likely to be formed in the nozzles 19 of the droplet discharger 12.

When the preceding wiping operation is performed with the wiping portion 149 coming into contact with the nozzle surface 18, the contact force of the wiping portion 149 with respect to the nozzle surface 18 in the preceding wiping operation and the finishing wiping operation may be appropriately changed. For example, the contact force of the wiping portion 149 with respect to the nozzle surface 18 in the preceding wiping operation may be the same as that in the finishing wiping operation and may be weaker than that in the finishing wiping operation.

The liquid receiver 131 may be provided above the casing 141 of the wiping mechanism 140 in the vertical direction. In this case, it is possible to perform the pressure reducing operation without moving the droplet discharger 12 after the cleaning operation is performed. Therefore, it is possible to suppress pressurized liquid leaking out from the nozzles 19 of the droplet discharger 12 due to vibration acting on the droplet discharger 12 when the droplet discharger 12 moves.

The liquid receiver 131 may be configured of a movable belt that can receive liquid. In this case, it is preferable that a component such as a motor for driving the belt be provided such that a portion of the belt that has received liquid can be changed to a portion of the belt that has not received liquid.

The pressing mechanism 48 may not be provided with the expansion and contraction portion 67 and may press the diaphragm 56 by adjusting the pressure in the air chamber 72. Specifically, the pressing mechanism 48 may displace the diaphragm 56 in a direction in which the volume of the liquid outflow portion 51 is reduced by increasing the pressure in the air chamber 72. The pressing mechanism 48 may displace the diaphragm 56 in a direction in which the volume of the liquid outflow portion 51 is increased by reducing the pressure in the air chamber 72. Note that, in a case where this configuration is adopted, as the pressure reducing operation, the pressure in the air chamber 72 may be reduced to a negative pressure lower than the atmospheric pressure such that the pressure in the droplet discharger 12 is reduced.

A buffer tank into which liquid flows and from which liquid flows out may be provided between the pressure adjustment mechanism 35 and the droplet discharger 12. In this case, it is preferable that a portion of a wall portion of the buffer tank be an elastically deformable flexible wall and a displacement mechanism for displacing the flexible wall be provided such that the volume of the buffer tank can be changed. In this case, it is possible to perform the pressure reducing operation by increasing the volume of the buffer tank after the cleaning operation is performed in a state where the volume of the buffer tank is reduced.

Liquid discharged by the droplet discharger 12 is not limited to ink and may be liquid into which functional particles are dispersed or mixed. For example, the droplet discharger 12 may discharge liquid in the form of a dispersion or a solution containing a material such as an electrode material or a pixel material used for production of liquid crystal displays, electroluminescent displays, and surface emission displays.

Hereinafter, the technical idea and the effect thereof figured out from the above-described embodiment and the modification examples will be described.

A droplet discharging apparatus includes: a droplet discharger including a common liquid chamber to which liquid is supplied from a liquid supply source via a liquid supply flow path, a plurality of pressure chambers communicating with the common liquid chamber, actuators provided respectively corresponding to the plurality of pressure chambers, nozzles provided respectively corresponding to the plurality of pressure chambers, and a discharge flow path coupled to the pressure chambers such that the liquid in the pressure chambers are discharged to an outside, the droplet discharger performing a recording process with respect to a recording medium by driving the actuators such that the liquid in the pressure chambers are discharged from the nozzles in the form of droplets; and a return flow path coupled to the discharge flow path and forming a circulation path for circulation of the liquid together with the liquid supply flow path. The droplet discharging apparatus performs, as a maintenance operation for the droplet discharger, a first discharge operation of causing the liquid in the pressure chambers to be discharged toward the return flow path via the discharge flow path when no droplets are discharged from the nozzles during the recording process.

According to this configuration, the liquid discharged from the pressure chambers to the return flow path via the discharge flow path coupled to the pressure chambers flows in the circulation path. Since the liquid flows, an increase in viscosity of the liquid is suppressed. Therefore, by using the first discharge operation, it is possible to suppress an increase in viscosity of liquid without discharging droplets from the nozzles. Therefore, it is possible to reduce the amount of liquid consumed for maintenance.

In the first discharge operation, the droplet discharging apparatus may cause the liquid to be discharged toward the return flow path with the liquid in the pressure chambers sucked from the discharge flow path side such that meniscuses on gas-liquid interfaces in the nozzles are maintained.

According to this configuration, when the liquid in the pressure chambers is sucked from the discharge flow path side, the meniscuses in the nozzles are moved toward the pressure chambers. That is, liquid in the nozzles flows. Therefore, an increase in viscosity of the liquid in the nozzles can be suppressed.

The droplet discharging apparatus may further include a detector configured to detect a state of insides of the pressure chambers by detecting vibration waveforms of the pressure chambers, and the droplet discharging apparatus may perform the first discharge operation when it is estimated, based on a result of the detection performed by the detector, that the state of the insides of the pressure chambers is abnormal since a volume of air bubbles present in the pressure chambers and the nozzles is equal to or greater than a set value.

When the volume of air bubbles present in the pressure chambers and the nozzles is small, the air bubbles may be eliminated by being dissolved in liquid with time. When the volume of the air bubbles is small, it is possible to remove the air bubbles from the pressure chambers and the nozzles without performing the first discharge operation by, for example, waiting for a predetermined time. On the contrary, when the volume of air bubbles present in the pressure chambers and the nozzles is large, the air bubbles may grow with time. According to the above-described configuration, the first discharge operation is performed when the air bubbles are not estimated to be eliminated with time. It is possible to decrease a frequency at which the first discharge operation is performed since it is not necessary to perform the first discharge operation when the air bubbles are estimated to be eliminated with time.

The droplet discharging apparatus may further include a detector configured to detect a state of insides of the pressure chambers by detecting vibration waveforms of the pressure chambers. The droplet discharging apparatus may estimate whether the state of the insides of the pressure chambers is improved or not by comparing the vibration waveforms of the pressure chambers that are detected by the detector at intervals and when it is estimated that the state of the insides of the pressure chambers is not improved, the droplet discharging apparatus may perform, as a maintenance operation for the droplet discharger, a second discharge operation of causing the liquid in the pressure chambers to be discharged to the outside from the nozzles.

According to this configuration, for example, when the state of the insides of the pressure chambers is not improved even after the first discharge operation is performed and when the state of the insides of the pressure chambers is not improved after the droplet discharging apparatus waits for a predetermined time, the second discharge operation of causing liquid in the pressure chambers to be discharged to the outside from the nozzles is performed. Since the second discharge operation is an operation of causing the liquid in the pressure chambers to be discharged to the outside from the nozzles, the second discharge operation is an operation that has a higher maintenance effect with respect to the droplet discharger than the first discharge operation of causing liquid in the pressure chambers to be discharged to the return flow path via the discharge flow path. In this manner, by performing the second discharge operation when the state of the inside of the pressure chamber is not improved with the first discharge operation, it is possible to appropriately perform maintenance of the droplet discharger.

The droplet discharging apparatus may further include a detector configured to detect a state of insides of the pressure chambers by detecting vibration waveforms of the pressure chambers. When the discharge flow path is a first discharge flow path, the droplet discharger may further include a second discharge flow path that is coupled to the common liquid chamber and the return flow path such that the liquid in the common liquid chamber is discharged to the outside without passing through the pressure chambers and when the number of pressure chambers estimated as the pressure chamber of which the inside is in an abnormal state due to air bubbles present in the pressure chamber and the nozzle based on the result of the detection performed by the detector is equal to or larger than a set number, the droplet discharging apparatus may perform, as a maintenance operation for the droplet discharger, a third discharge operation of causing the liquid in the common liquid chamber to be discharged toward the return flow path via the second discharge flow path before the first discharge operation is performed.

When the number of pressure chambers estimated as the pressure chamber of which the inside is in an abnormal state due to air bubbles present in the pressure chamber and the nozzle is equal to or larger than the set number, it is considered that air bubbles are present in the common liquid chamber communicating with the plurality of pressure chambers. Therefore, when the number of pressure chambers estimated as the pressure chamber of which the inside is in an abnormal state due to air bubbles present in the pressure chamber and the nozzle is equal to or larger than the set number, the third discharge operation of causing liquid in the common liquid chamber to be discharged toward the return flow path via the second discharge flow path coupled to the common liquid chamber and the return flow path is performed. Accordingly, it is possible to discharge liquid in the common liquid chamber in which air bubbles are expected to be present.

The droplet discharging apparatus may perform, as the maintenance operation for the droplet discharger, a fourth discharge operation of causing the liquid in the pressure chambers to be discharged toward the return flow path via the discharge flow path at a flow rate lower than the first discharge operation when droplets are discharged from the nozzles during the recording process.

When liquid in the pressure chambers is discharged toward the return flow path via the discharge flow path coupled to the pressure chambers in order to suppress an increase in viscosity of liquid, the pressure in the pressure chambers becomes unstable due to the flow of liquid. If the pressure in the pressure chambers becomes unstable when droplets are discharged from the nozzles during the recording process, the discharge accuracy of the nozzles discharging droplets is decreased. Therefore, when droplets are discharged from the nozzles during the recording process, the fourth discharge operation of causing liquid in the pressure chambers to be discharged toward the return flow path via the discharge flow path coupled to the pressure chambers at a flow rate lower than the first discharge operation is performed in this configuration. In the fourth discharge operation, the pressure in the pressure chambers does not significantly fluctuate since the flow rate is low in comparison with the first discharge operation. That is, by performing the fourth discharge operation, it is possible to suppress an increase in viscosity of liquid while suppressing a fluctuation in pressure in the pressure chambers even when droplets are discharged from the nozzles during the recording process.

The droplet discharging apparatus may further include a cap configured to cap a nozzle surface in which the nozzles are open. The droplet discharging apparatus may perform, as a maintenance operation for the droplet discharger, a fifth discharge operation of causing the liquid in the pressure chambers to be discharged toward the return flow path via the discharge flow path at a flow rate higher than the first discharge operation in a state where the nozzle surface is capped by the cap when the recording process is not performed.

When liquid in the pressure chambers is discharged toward the return flow path via the discharge flow path coupled to the pressure chambers in order to suppress an increase in viscosity of liquid, the pressure in the pressure chambers fluctuates due to the flow of liquid. If a flow rate at which the liquid flows from the pressure chambers to the return flow path is high, the pressure in the pressure chambers significantly fluctuates and thus there is a possibility that the outside air enters the pressure chambers through the nozzles or the liquid flows out through the nozzles. However, if the nozzle surface is capped by the cap when liquid in the pressure chambers is discharged toward the return flow path via the discharge flow path coupled to the pressure chambers, a possibility that the outside air enters the pressure chambers through the nozzles or the liquid flows out from the nozzles due to a fluctuation in pressure in the pressure chambers is decreased. Therefore, in a state where the nozzle surface is capped by the cap, it is possible to make a flow rate at which liquid is discharged from the insides of the pressure chambers toward the return flow path via the discharge flow path higher. According to the above-described configuration, by performing the fifth discharge operation with the nozzle surface capped, it is possible to effectively perform maintenance of the droplet discharger.

There is provided a maintenance method for a droplet discharging apparatus which includes: a droplet discharger including a common liquid chamber to which liquid is supplied from a liquid supply source via a liquid supply flow path, a plurality of pressure chambers communicating with the common liquid chamber, actuators provided respectively corresponding to the plurality of pressure chambers, nozzles provided respectively corresponding to the plurality of pressure chambers, and a discharge flow path coupled to the pressure chambers such that the liquid in the pressure chambers are discharged to an outside, the droplet discharger performing a recording process with respect to a recording medium by driving the actuators such that the liquid in the pressure chambers are discharged from the nozzles in the form of droplets; and a return flow path coupled to the discharge flow path and forming a circulation path for circulation of the liquid together with the liquid supply flow path, the method including: performing, as a maintenance operation for the droplet discharger, a first discharge operation of causing the liquid in the pressure chambers to be discharged toward the return flow path via the discharge flow path when no droplets are discharged from the nozzles during the recording process.

According to this method, the liquid discharged from the pressure chambers to the return flow path via the discharge flow path coupled to the pressure chambers flows in the circulation path. Since the liquid flows, an increase in viscosity of the liquid is suppressed. Therefore, by using the first discharge operation, it is possible to suppress an increase in viscosity of liquid without discharging droplets from the nozzles. Therefore, it is possible to reduce the amount of liquid consumed for maintenance.

In the maintenance method for a droplet discharging apparatus, as the maintenance operation for the droplet discharger, a fourth discharge operation of causing the liquid in the pressure chambers to be discharged toward the return flow path via the discharge flow path at a flow rate lower than the first discharge operation may be performed when droplets are discharged from the nozzles during the recording process.

When liquid in the pressure chambers is discharged toward the return flow path via the discharge flow path coupled to the pressure chambers in order to suppress an increase in viscosity of liquid, the pressure in the pressure chambers becomes unstable due to the flow of liquid. If the pressure in the pressure chambers becomes unstable when droplets are discharged from the nozzles during the recording process, the discharge accuracy of the nozzles discharging droplets is decreased. Therefore, when droplets are discharged from the nozzles during the recording process, the fourth discharge operation of causing liquid in the pressure chambers to be discharged toward the return flow path via the discharge flow path coupled to the pressure chambers at a flow rate lower than the first discharge operation is performed in this method. In the fourth discharge operation, the pressure in the pressure chambers does not significantly fluctuate since the flow rate is low in comparison with the first discharge operation. That is, by performing the fourth discharge operation, it is possible to suppress an increase in viscosity of liquid while suppressing a fluctuation in pressure in the pressure chambers even when droplets are discharged from the nozzles during the recording process.

In the maintenance method for a droplet discharging apparatus, the droplet discharging apparatus may further include a cap configured to cap a nozzle surface in which the nozzles are open, and, as a maintenance operation for the droplet discharger, a fifth discharge operation of causing the liquid in the pressure chambers to be discharged toward the return flow path via the discharge flow path at a flow rate higher than the first discharge operation may be performed in a state where the nozzle surface is capped by the cap when the recording process is not performed.

When liquid in the pressure chambers is discharged toward the return flow path via the discharge flow path coupled to the pressure chambers in order to suppress an increase in viscosity of liquid, the pressure in the pressure chambers fluctuates due to the flow of liquid. If a flow rate at which the liquid flows from the pressure chambers to the return flow path is high, the pressure in the pressure chambers significantly fluctuates and thus there is a possibility that the outside air enters the pressure chambers through the nozzles or the liquid flows out through the nozzles. However, if the nozzle surface is capped by the cap when liquid in the pressure chambers is discharged toward the return flow path via the discharge flow path coupled to the pressure chambers, a possibility that the outside air enters the pressure chambers through the nozzles or the liquid flows out from the nozzles due to a fluctuation in pressure in the pressure chambers is decreased. Therefore, in a state where the nozzle surface is capped by the cap, it is possible to make a flow rate at which liquid is discharged from the insides of the pressure chambers toward the return flow path via the discharge flow path higher. According to the above-described configuration, by performing the fifth discharge operation with the nozzle surface capped, it is possible to effectively perform maintenance of the droplet discharger.

What is claimed is:

1. A droplet discharging apparatus comprising:

a droplet discharger including a common liquid chamber to which liquid is supplied from a liquid supply source via a liquid supply flow path, a plurality of pressure chambers communicating with the common liquid chamber, actuators provided respectively corresponding to the plurality of pressure chambers, nozzles provided respectively corresponding to the plurality of pressure chambers, and a discharge flow path coupled to the pressure chambers such that the liquid in the pressure chambers are discharged to an outside, the droplet discharger performing a recording process with respect to a recording medium by driving the actuators such that the liquid in the pressure chambers are discharged from the nozzles in the form of droplets;

a return flow path coupled to the discharge flow path and forming a circulation path for circulation of the liquid together with the liquid supply flow path; and a controller performing, as a maintenance operation for the droplet discharger, a first discharge operation of causing the liquid in the pressure chambers to be discharged toward the return flow path via the discharge flow path when no droplets are discharged from the nozzles during the recording process.

2. The droplet discharging apparatus according to claim 1, wherein in the first discharge operation, the controller causes the liquid to be discharged toward the return flow path with the liquid in the pressure chambers sucked from the discharge flow path side such that meniscuses on gas-liquid interfaces in the nozzles are maintained.

3. The droplet discharging apparatus according to claim 1, further comprising:

a detector configured to detect a state of insides of the pressure chambers by detecting vibration waveforms of the pressure chambers, wherein the controller performs the first discharge operation when it is estimated, based on a result of the detection performed by the detector, that the state of the insides of the pressure chambers is abnormal since a volume of air bubbles present in the pressure chambers and the nozzles is equal to or greater than a set value.

4. The droplet discharging apparatus according to claim 1, further comprising:

a detector configured to detect a state of insides of the pressure chambers by detecting vibration waveforms of the pressure chambers, wherein the controller estimates whether the state of the insides of the pressure chambers is improved or not by comparing the vibration waveforms of the pressure chambers that are detected by the detector at intervals and when it is estimated that the state of the insides of the pressure chambers is not improved, the controller performs, as a maintenance operation for the droplet discharger, a second discharge operation of causing the liquid in the pressure chambers to be discharged to the outside from the nozzles.

5. The droplet discharging apparatus according to claim 1, further comprising:

a detector configured to detect a state of insides of the pressure chambers by detecting vibration waveforms of the pressure chambers, wherein when the discharge flow path is a first discharge flow path, the droplet discharger further includes a second discharge flow path that is coupled to the common liquid chamber and the return flow path such that the liquid in the common liquid chamber is discharged to the outside without passing through the pressure chambers, and when the number of pressure chambers estimated as the pressure chamber of which the inside is in an abnormal state due to air bubbles present in the pressure chamber and the nozzle based on the result of the detection performed by the detector is equal to or larger than a set number, the controller performs, as a maintenance operation for the droplet discharger, a third discharge operation of causing the liquid in the common liquid chamber to be discharged toward the return flow path via the second discharge flow path before the first discharge operation is performed.

6. The droplet discharging apparatus according to claim 5, wherein the controller performs, as the maintenance operation for the droplet discharger, a fourth discharge operation of causing the liquid in the pressure chambers to be discharged toward the return flow path via the discharge flow path at a flow rate lower than the first discharge operation when droplets are discharged from the nozzles during the recording process.

7. The droplet discharging apparatus according to claim 6, further comprising:

a cap configured to cap a nozzle surface in which the nozzles are open, wherein the controller performs, as a maintenance operation for the droplet discharger, a fifth discharge operation of causing the liquid in the pressure chambers to be discharged toward the return flow path via the discharge flow path at a flow rate higher than the first discharge operation in a state where the nozzle surface is capped by the cap when the recording process is not performed.

8. A maintenance method for a droplet discharging apparatus which includes: a droplet discharger including a common liquid chamber to which liquid is supplied from a liquid supply source via a liquid supply flow path, a plurality of pressure chambers communicating with the common liquid chamber, actuators provided respectively corresponding to the plurality of pressure chambers, nozzles provided respectively corresponding to the plurality of pressure chambers, and a discharge flow path coupled to the pressure chambers such that the liquid in the pressure chambers are discharged to an outside, the droplet discharger performing a recording process with respect to a recording medium by driving the actuators such that the liquid in the pressure chambers are discharged from the nozzles in the form of droplets; and a return flow path coupled to the discharge flow path and forming a circulation path for circulation of the liquid together with the liquid supply flow path, the method comprising:

performing, as a maintenance operation for the droplet discharger, a first discharge operation of causing the liquid in the pressure chambers to be discharged toward the return flow path via the discharge flow path when no droplets are discharged from the nozzles during the recording process.

9. The maintenance method for a droplet discharging apparatus according to claim 8, wherein as the maintenance operation for the droplet discharger, a fourth discharge operation of causing the liquid in the pressure chambers to be discharged toward the return flow path via the discharge flow path at a flow rate lower than the first discharge operation is performed when droplets are discharged from the nozzles during the recording process.

10. The maintenance method for a droplet discharging apparatus according to claim 8, wherein the droplet discharging apparatus further includes a cap configured to cap a nozzle surface in which the nozzles are open, and as a maintenance operation for the droplet discharger, a fifth discharge operation of causing the liquid in the pressure chambers to be discharged toward the return flow path via the discharge flow path at a flow rate higher than the first discharge operation is performed in a state where the nozzle surface is capped by the cap when the recording process is not performed.

* * * * *